US008539867B2

(12) United States Patent
Powell et al.

(10) Patent No.: US 8,539,867 B2
(45) Date of Patent: Sep. 24, 2013

(54) PERFORATOR

(75) Inventors: Wade A. Powell, Meridian, ID (US); Scott K. Carter, Jr., Caldwell, ID (US); Mark McDonnell, Meridian, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/423,238

(22) Filed: Mar. 18, 2012

(65) Prior Publication Data

US 2012/0174720 A1 Jul. 12, 2012

Related U.S. Application Data

(62) Division of application No. 11/173,535, filed on Jul. 1, 2005, now Pat. No. 8,166,857.

(51) Int. Cl.
*B26F 1/24* (2006.01)

(52) U.S. Cl.
USPC ..... 83/13; 83/30; 83/659; 83/886; 225/4

(58) Field of Classification Search
USPC ..... 83/13, 30, 879, 883, 886, 333, 509–510, 83/658–659, 927; 225/1–5
IPC ..... B41J 11/70
See application file for complete search history.

(56) References Cited

U.S. PATENT DOCUMENTS 1,015,580 A 1/1912 Nichols
2,328,109 A 8/1943 Thompson
3,124,349 A 3/1964 Huffman
3,314,340 A 4/1967 Bishop
3,771,399 A 11/1973 Aterianus
3,795,163 A 3/1974 Armstrong et al.
3,954,034 A 5/1976 Broderick
3,980,291 A 9/1976 Loase
4,196,028 A 4/1980 Mills et al.
4,682,767 A 7/1987 Littleton
4,765,604 A 8/1988 Trogan
4,917,364 A 4/1990 Lida et al.
5,000,729 A 3/1991 Yamauchi
5,265,508 A 11/1993 Bell et al.
5,365,819 A 11/1994 Maida et al.
5,405,127 A 4/1995 Welborn
5,429,579 A 7/1995 Nishihara
5,460,844 A 10/1995 Gaylor
5,495,672 A 3/1996 Kritchever et al.
5,641,551 A 6/1997 Simpson et al.
5,758,560 A 6/1998 Fiscus
5,993,369 A 11/1999 Sekita et al.
6,009,781 A 1/2000 McNeil
6,024,685 A 2/2000 Kirsch
6,179,764 B1 1/2001 Eckert
6,209,291 B1 4/2001 Delen et al.
6,383,124 B1 5/2002 St. Germain et al.
6,627,026 B2 9/2003 Andersson et al.
6,901,647 B2 6/2005 Foster et al.
6,941,849 B1 9/2005 Bausela et al.

(Continued)

*Primary Examiner* — Phong Nguyen
(74) *Attorney, Agent, or Firm* — Robert Wasson

(57) ABSTRACT

A perforating method comprising the steps of providing a pair of rotatable members, each rotatable member having anvils and perforating blades, rotating the first rotatable member in a clockwise direction while concurrently rotating the second rotatable member in a counterclockwise direction, and rotating the first rotatable member in the counterclockwise direction while concurrently rotating the second rotatable member in the clockwise direction.

21 Claims, 10 Drawing Sheets

(56) References Cited

U.S. PATENT DOCUMENTS

2003/0132549 A1 7/2003 Mlinar et al.
2004/0063559 A1 4/2004 Ochsenbauer
2004/0154485 A1 8/2004 Boss
2004/0256509 A1 * 12/2004 Dorscht ..... 242/332.4

* cited by examiner

FIG. 7
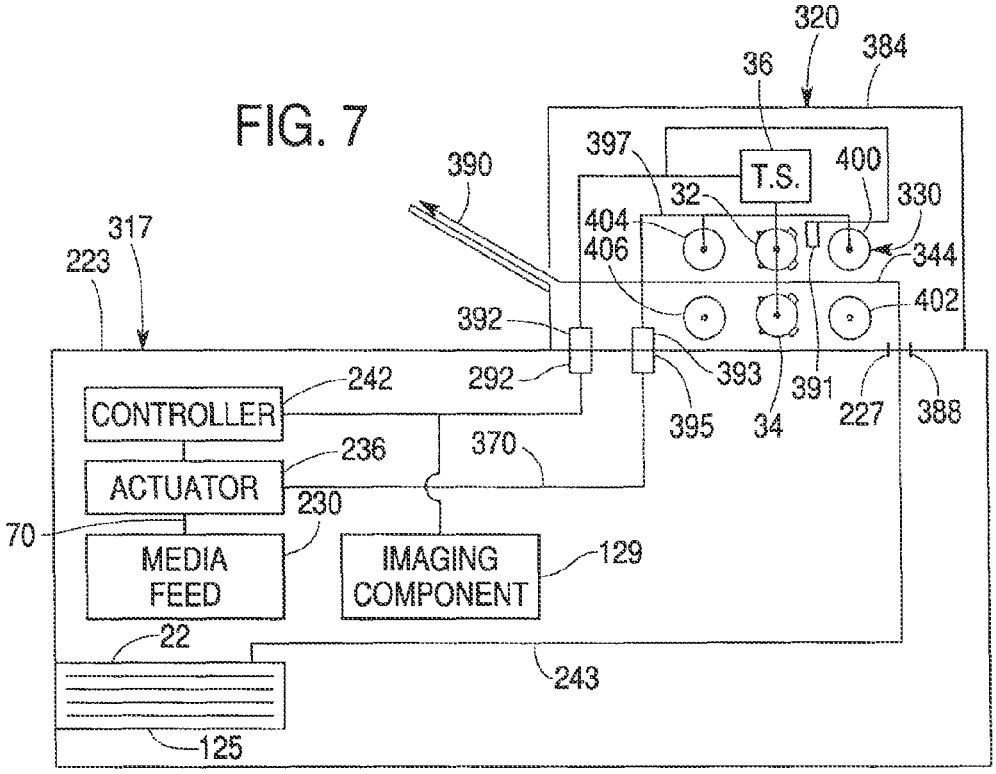
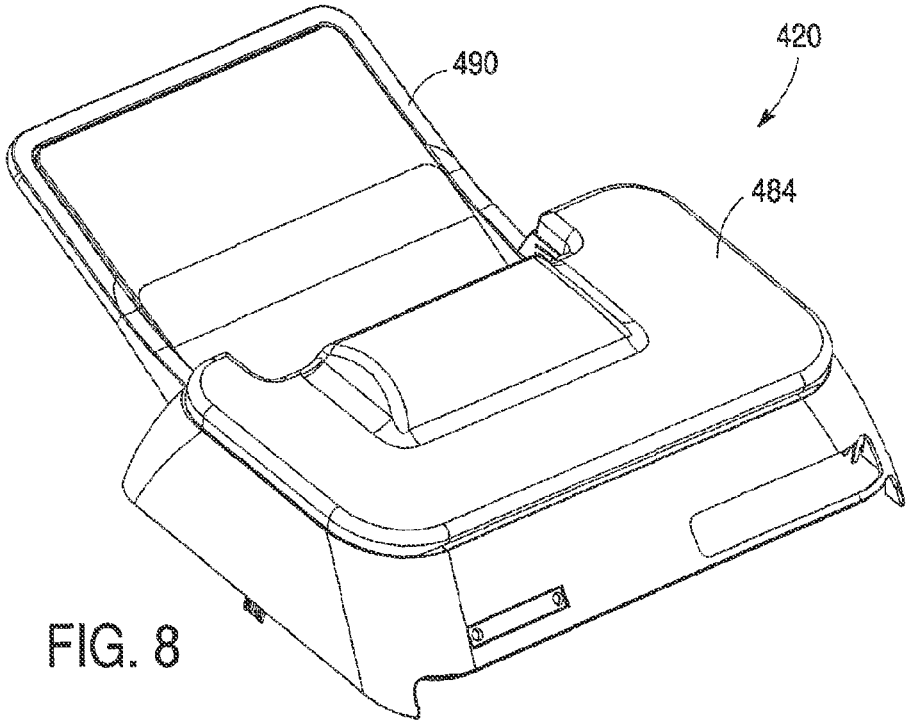
FIG. 8

PERFORATOR

The present application is a divisional application of co-pending U.S. patent application Ser. No. 11/173,535 filed on Jul. 1, 2005 by Wade A. Powell, Scott K. Carter, Jr., Mark McDonnell and entitled PERFORATOR, the full disclosure of which is hereby incorporated by reference.

BACKGROUND

Perforations are sometimes formed in a medium to facilitate removal of portions of the medium or for other purposes. Existing devices for perforating a medium may be expensive and may be difficult to adjust. In addition, such devices also may be noisy, difficult to use, and space consuming.

BRIEF DESCRIPTION OF THE DRAWINGS

FIG. 7 schematically illustrates another embodiment of the perforator system of FIG. 1 configured as an add-on module for use with an imaging system according to one exemplary embodiment.

FIG. 8 is a top perspective view of an embodiment of the perforator system of FIG. 7 according to one exemplary embodiment.

DETAILED DESCRIPTION OF EXAMPLE EMBODIMENTS

Figure 1:
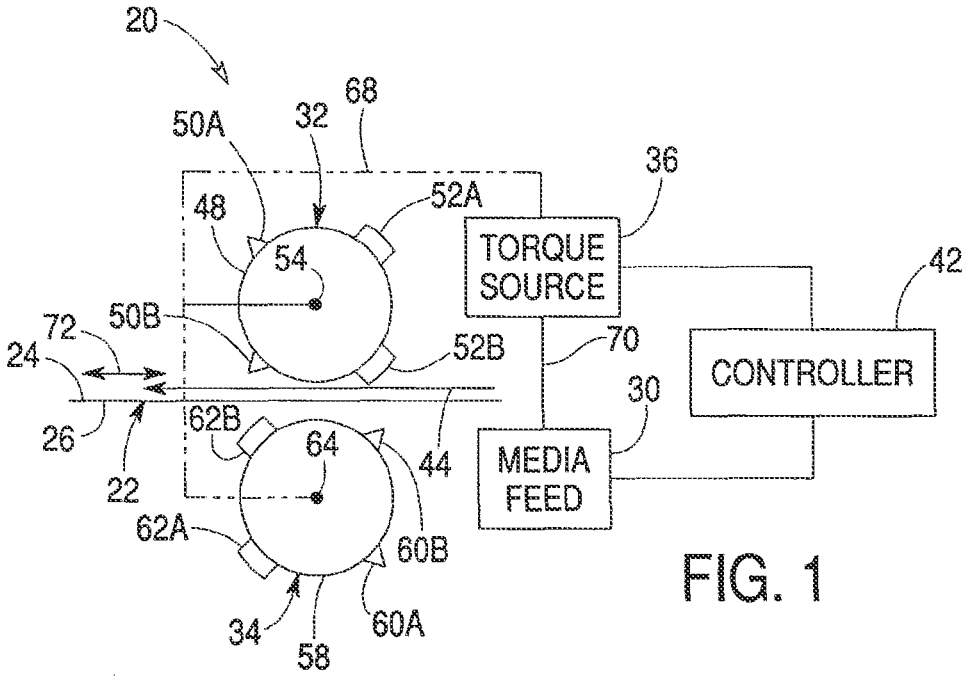
FIG. 1 schematically illustrates a perforator system in an open state according to one exemplary embodiment.

FIG. 1 schematically illustrates perforator system 20 which is configured to selectively form perforations in a sheet of media 22 having a first face 24 and a second opposite face 26. Perforator system 20 generally includes media feed 30, perforator components 32, 34, torque source 36 and controller 42. Media feed 30 comprises a mechanism configured to move media 22 along a media path 44 between perforator components 32 and 34. In an open state of system 20, media feed 30 moves media 22 between components 32 and 34 while components 32 and 34 are substantially stationary. In a perforating state of system 20, media feed 30 moves or drives media 22 between components 32 and 34 while components 32 and 34 are rotating and engage media 22. In one embodiment, media feed 30 may comprise one or more rollers configured to engage media 22. In other embodiments, media feed 30 may comprise other media engaging structures such as belts, webs and the like.

Perforator components 32 and 34 comprise individual components configured to cooperate with one another to form one or more perforations in media 22. Perforator component 32 includes rotatable member 48, blades 50A, 50B (collectively referred to as blades 50) and anvils 52A, 52B (collectively referred to as anvils 52). In some embodiments, each of blades 50A, 50B may comprise a set of discrete blades, knives, or pins arranged in a substantially linear fashion to cut small holes or otherwise weaken the media 22 along a line perpendicular to the directions indicated by arrows 72. Each of the anvils 52A, 52B may comprise a structure having holes that are sized and arranged to permit corresponding ones of the blades, knives, or pins of the blades 50A, 50B to at least partially engage the holes to perforate the media 22. Perforator component 34 is similar to perforator component 32 and includes rotatable member 58, blades 60A, 60B (collectively referred to as blades 60) and anvils 62A, 62B (collectively referred to as anvils 62). Rotatable members 48 and 58 comprise structures configured for rotation about axes 54 and 64, respectively, which extend generally parallel to one another. Rotatable member 48 supports blades 50 and anvils 52. Rotatable member 58 supports blades 60 and anvils 62. In the particular example illustrated, rotatable members 48 and 58 comprise elongate cylindrical members. In other embodiments, rotatable members 48 and 58 may have other configurations. For example, in other embodiments, support members 48 and 58 may have polygonal cross-sectional shapes.

Blades 50 and blades 60 comprise structures configured to cooperate with anvils 62 and 52, respectively, to form one or more perforations in media 22. In the particular embodiment illustrated, blades 50 engage face 24 while anvils 62 engage face 26 of sheet 22 during perforating. Blades 60 engage face 26 while anvils 52 engage face 24 of media 22 during perforating.

Blades 50 and blades 60 may comprise series of elongate structures providing multiple axially spaced points configured to form a line of apertures or indentations in media 22

(i.e., a perforation). Blades 50 and blades 60 are configured in some embodiments to at least partially pierce or perforate media 22.

Anvils 52 and anvils 62 generally comprise structures coupled to rotatable members 48 and 58, respectively, configured to cooperate with blades 60 and blades 50, respectively, to form perforations in media 22. Anvils 52 and anvils 62 generally comprise structures that are resiliently compressible or resiliently compliant such that blades 60 and blades 50 may depress and pierce media 22 against and into anvils 52 and anvils 62 respectively. In one embodiment, anvils 52 and anvils 62 each include a series of holes to receive portions of blades 50, 60, respectively. In other embodiments, anvils 52 and anvils 62 may be formed from resilient materials and may have configurations other than that shown.

As further shown by FIG. 1, blades 50 and anvils 52 of perforator component 32 are angularly spaced from one another about axis 54 and blades 60 and anvils 62 are angularly spaced from one another about axis 64 by a sufficient degree such that perforator components 32 and 34 may be rotated to position blades 50 and 60 sufficiently apart from one another on opposite sides of media 22 and to position anvils 52 and 62 sufficiently apart from one another on opposite sides of media 22 to allow media 22 to pass between perforator components 32 and 34 without being perforated. In the particular example shown, the distance between axes 54, 64 and the outer most points of blades 50 and anvils 52 and blades 60 and anvils 62, respectively, as well as the angular spacing between blades 50 and anvils 52 and blades 60 and anvils 62 is such that media 22 may be passed between perforator components 32 and 34 while remaining in a plane or substantially linear media path 44.

In the particular example illustrated, rotatable members 48 and 58 each have a diameter of about 22 millimeters, each of blades 50 and 60 project from rotatable members 48 and 58 by a distance of about 1.7 millimeters and each of anvils 52 and 62 project from members 48 and 58 by a distance of about 1.7 millimeters. Axes 54 and 64 are spaced from one another by a distance of about 25.4 millimeters (1 inch). As a result, media path 44 may extend in a plane between perforator components 32 and 34 and perpendicular to axes 54 and 64 while accommodating media 22 having a thickness of up to about 3.4 millimeters. In other embodiments, the dimensions of rotatable member 48 and 58 as well as angular spacings between blades 50, 60 and anvils 52, 62, respectively, may be varied depending upon the thickness of media 22 to be accommodated while still permitting media 22 to pass between perforator components 32 and 34 relative to perforator components 32 and 34 without being perforated.

In the particular example shown in FIG. 1, blades 50, 60 and anvils 52, 62 are angularly spaced from one another so as to also reduce the degree by which rotatable members 48 and 58 are rotated to perforate media 22. In the particular example shown in which blades 50, 60 and anvils 52, 62 are angularly spaced from one another by about 90 degrees, rotation of members 48 and 58 through a maximum angle of 90 degrees results in media 22 being perforated into face 24 or alternatively into face 26. From the open position shown in FIG. 1, components 48 and 50 are rotated 45 degrees in a first direction to perforate media 22 into face 24 and in a second direction to perforate media 22 into face 26.

Torque source 36 comprises a device configured to supply torque to perforator components 32 and 34. In one embodiment, torque source 36 comprises a motor. Torque source 36 is operably coupled to perforator components 32 and 34 by transmission 68 which may comprise a series of gears, a belt and pulley arrangement, a chain and sprocket arrangement, a toothed pinion and toothed belt arrangement and the like. In one embodiment, transmission 68 is configured such that torque source 36 synchronously drives or rotates perforator components 32 and 34. In other embodiments, torque source 36 and transmission 68 may be configured to independently rotate perforator components 32 and 34. In one embodiment, torque source 36 may comprise independent motors or other sources of torque for independently driving components 32 and 34.

As further shown by FIG. 1, torque source 36 is additionally operably coupled to media feed 30 by transmission 70 which may comprise a series of gears, a belt and pulley arrangement, a chain and sprocket arrangement, a toothed pinion and toothed belt and the like. Torque source 36 supplies torque to drive media feed 30. In other embodiments, system 20 may utilize sources of torque other than torque source 36 for driving media feed 30.

Controller 42 comprises a processing unit configured to generate control signals directing the operation of media feed 30 and torque source 36. For purposes of this disclosure, the term "processing unit" shall mean a conventionally known or future developed processor that executes sequences of instructions contained in a memory. Execution of the sequences of instructions causes the processor to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. Controller 42 is not limited to any specific combination of hardware circuitry and software, nor to any particular source for the instructions executed by the processing unit.

Figure 2:
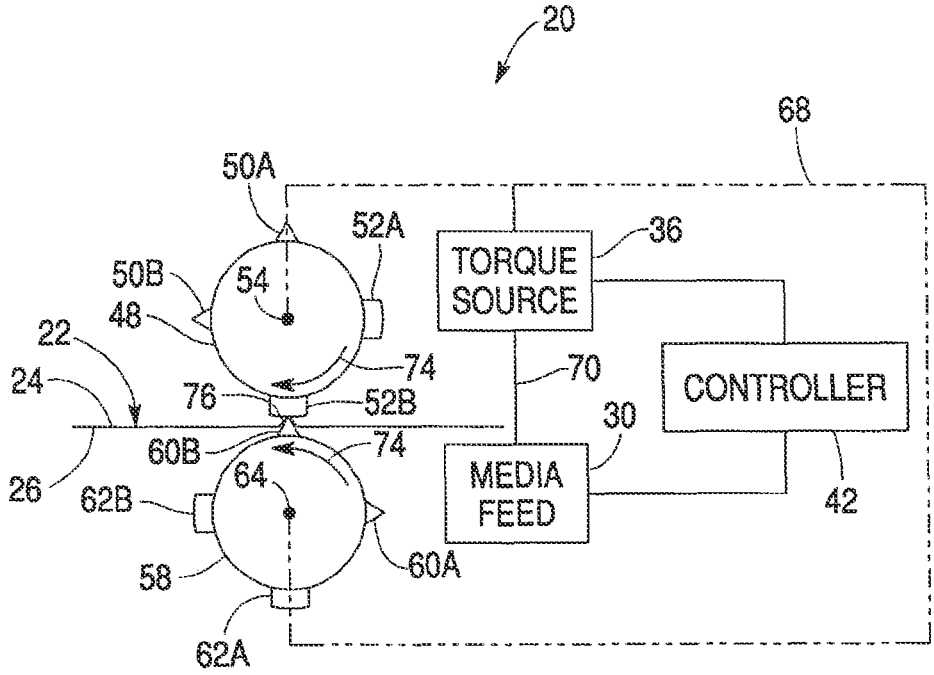
FIG. 2 schematically illustrates the perforator system of FIG. 1 in a first perforating state according to one exemplary embodiment.
Figure 3:
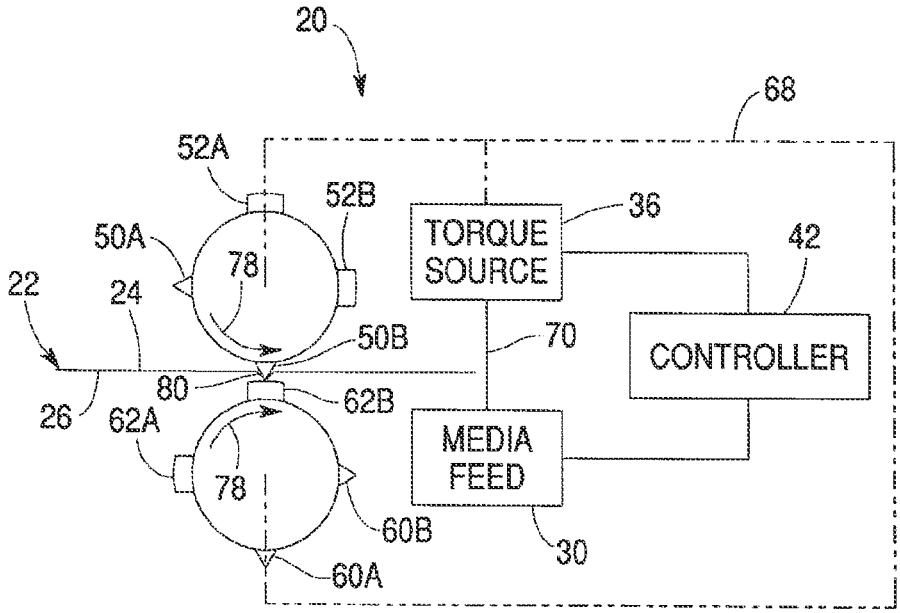
FIG. 3 schematically illustrates the perforator system of FIG. 1 in a second perforating state according to one exemplary embodiment.

FIGS. 1-3 schematically illustrate example operation states for perforator system 20. FIG. 1 illustrates torque source 36 rotatably driving perforator components 32 and 34 to the open position shown. Once in this open position, perforator components 32 and 34 are generally stationary and do not rotate. In other embodiments, components 32 and 34 may be rotating, but at a slower surface velocity as compared to movement of media 22 by media feed 30. As a result, anvils 50, 60, and blades 52, 62 may be positioned at one of a continuum of potential locations relative to media 22. In other words, components 32 and 34 may be positioned on opposite sides of media 22 at any one of a number of locations along media 22. For example, a multitude of different lengths of media 22, including lengths greater than the circumferential spacing between consecutive anvils 50, 60, and blades 60, 62, may be moved past components 32 and 34. This enables perforations to be formed at multiple locations and variable spacings. For example, perforations may be formed at 0.25 inches from the edge of media 22, at 0.5 inches from the edge of media 22, at 3 inches from the edge of media 22, at 3.25 inches from the edge of media 22 and so on.

FIG. 1 further illustrates media feed 30 moving media 22 between perforator components 32 and 34 relative to perforator components 32 and 34 along media path 44 in either of the directions indicated by the arrows 72. As a result, media feed 30 may position media 22 at any one of a multitude relative positions with respect to components 32 and 34 for forming perforations in media 22 at multiple locations with selected spacings between such multiple perforations.

Although FIG. 1 illustrates media 22 as passing between, relative to and potentially in contact with stationary or slower moving opposing portions of rotatable members 48 and 58 between blades 50B, 60B and anvils 52B, 62B, media 22 may also be moved between and relative to other opposing stationary or slower moving portions of rotatable members 48 and 58 located between other anvils and other blades. For example, perforator components 32 and 34 may alternatively be positioned such that media 22 is moved past and between stationary or slower moving opposing portions of rotatable members 48 and 58 extending between anvils 52A and 52B and between blades 60A and 60B. The particular angular positioning of perforator components 32 and 34 may be varied depending upon a desired perforate pattern to be formed in media 22. In some embodiments, the blades and anvils described herein may be replaced with the blades and anvils described in U.S. patent application Ser. No. 11/101,329, entitled "Creaser" and filed Apr. 7, 2005, which is hereby incorporated by reference.

FIG. 2 schematically illustrates perforator system 20 in a first perforating state in which media 22 is perforated from side or face 26. In particular, once media 22 has been properly positioned with respect to perforator components 32 and 34 while components 32 and 34 are in the open state shown in FIG. 1, torque source 36, in response to control signals from controller 42, rotates components 32 and 34 in the direction indicated by arrows 74 to move blade 60*b* into engagement with face 26 of media 22 opposite to and against anvil 52B. In the particular example shown, one or more tips of blade 60B pierces media 22 against anvil 52B to form perforation 76 in media 22. In one embodiment, perforation 76 may be formed entirely across media 22. In another embodiment, perforation 76 may be intermittently located and spaced along media 22. Perforation 76 facilitates subsequent tearing of media 22 along perforation 76. Perforation 76 facilitates the creation of a straight and properly located tear by a person manually tearing media 22 along perforation 76.

FIG. 3 schematically illustrates perforator system 20 in a second perforating state after media 22 has been appropriately positioned with respect to perforator components 32 and 34 as shown in FIG. 1. As shown in FIG. 3, torque source 36 has rotated perforator components 32 and 34 in the direction indicated by arrows 78 from the position shown in FIG. 1 to the position shown in FIG. 3 in which blade 50B engages and pierces side or face 24 of media 22 against an opposite anvil 62B to form perforation 80 extending into face 24 of media 22.

In the particular example shown, the blades 50 are consecutively coupled to rotatable member 48 and anvils 52 are consecutively coupled to rotatable member 48. Likewise, blades 60 are consecutively coupled to rotatable member 58 and anvils 62 are consecutively coupled to rotatable member 58. In other words, blades 50 are coupled to rotatable member 48 without intervening or intermediate anvils. Blades 60 are coupled to a rotatable member 58 without intervening or intermediate anvils. Anvils 52 are coupled to rotatable member 48 without intermediate or intervening blades. Likewise, anvils 62 are coupled to rotatable member 58 without intermediate or intervening blades. Blades 60 are configured to interact with anvils 52 while blades 50 are configured to interact with anvils 62. This arrangement of blades 50, blades 60, anvils 52 and anvils 62 enables system 20 to selectively form consecutive perforations 76 along media 22, consecutive perforations 80 along media 22 or to consecutively form perforations 76 and 80 in any order. Because system 20 may consecutively form perforations 76, may consecutively form perforations 80 or may consecutively form perforations 76 and 80 in any order and because system 20 is configured to move media 22 between and relative to perforator components 32 and 34 to consecutively control the spacing or distance between perforations 76 and/or 80, system 20 may form a variety of perforate patterns in media 22 to facilitate a variety of tearing patterns.

Figure 4:
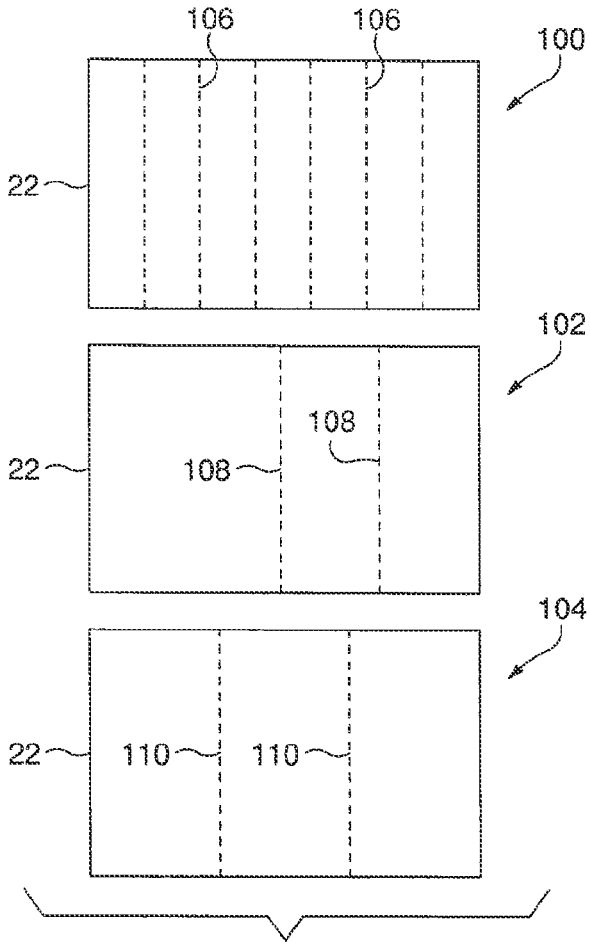
FIG. 4 illustrates different perforation patterns according to one exemplary embodiment.

FIG. 4 illustrates three example tear patterns that may be formed by tearing media 22 along patterns of perforations 76 and 80 formed by system 20. In particular, FIG. 4 illustrates first pattern 100, second pattern 102, and third pattern 104. The first pattern 100 comprises a series of six substantially linear sets of perforations 106 formed in media 22. The sets of perforations 106 are shown as being evenly spaced, but may have different spacings between adjacent sets of perforations 106. The second pattern 102 includes two sets of perforations 108 located in non-symmetrical fashion on the media 22. The third pattern 104 shows sets of perforations 110.

Figure 5:
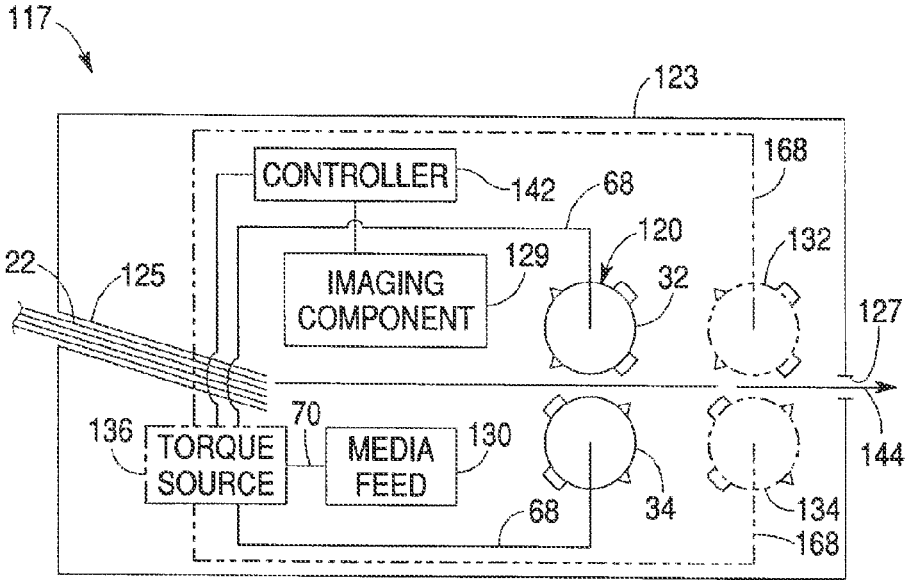
FIG. 5 schematically illustrates another embodiment of the perforator system of FIG. 1 incorporated into an imaging system according to one exemplary embodiment.

FIG. 5 schematically illustrates perforator system 120, another embodiment of perforator system 20, incorporated as part of an imaging system 117. In addition to perforator system 120, imaging system 117 includes housing 123, media input 125, media output 127 and imaging component 129. Perforator system 120 is similar to perforator system 20 except that perforator system 120 includes media feed 130, torque source 136 and controller 142 in lieu of media feed 30, torque source 36 and controller 42, respectively. Media feed 130 is similar to media feed 30 except that media feed 130 is configured to move media 22 along a media path 144 from media input 125, relative to imaging component 129 and to media output 127. In the particular example shown, media feed 130 is configured to pick an individual sheet of media 22 from a stack of sheets of media 22 provided at media input 125. Media feed 130 is further configured to position the picked sheet 22 relative to imaging component 129 and to move the sheet of media 22 relative to perforator components 32 and 34 during perforating. After perforating, media feed 130 is configured to move the perforated sheet of media 22 to media output 127. As shown in FIG. 5, when perforator components 32 and 34 are in an open state, media feed 130 may move a sheet of media 22 relative to perforator components 32 and 34 while perforator components 32 and 34 remain stationary and without additional perforating of the sheet of media 22 being moved between perforator components 32 and 34. As discussed above, this facilitates selective positioning of the sheet of media 22 relative to perforator components 32 and 34 for forming perforations in the sheet of media 22 at selected spacings. Media feed 130 may comprise a drum, a series of rollers, a series of belts, shuttle trays, and combinations thereof as well as other mechanisms configured to move and transport media 22.

Torque source 136 is similar to torque source 36 except that torque source 136 is configured to supply torque to media feed 130 in lieu of media feed 30. Torque source 136 may comprise one or more individual sources of torque, such as motors, which are operably coupled to media feed 130 by transmission 70 (described above). In one embodiment, torque source 136 may comprise a first motor configured to supply torque to media feed 130 and a second distinct motor, such as a stepper motor, configured to supply torque to perforator components 32 and 34.

Controller 142 is similar to controller 42 except that controller 142 is configured to generate additional control signals directing the operation of imaging component 129. In particular, controller 142 comprises one or more processing units configured to generate control signals directing the operation of torque source 136 which drives media feed 130 and perforator components 32, 34. Controller 142 further generates control signals based upon input image data directing the operation of imaging component 129.

With the incorporation of perforator system 120, imaging system 117 is configured to form an image upon media 22 while also perforating media 22 for subsequent tearing. Housing 123 of imaging system 117 generally comprises a structure configured to support and enclose each of the components of imaging system 117. As a result, imaging system 117 is a generally self-contained unit. The exact configuration of housing 123 may vary depending upon such factors as the other components of imaging system 117.

Media input 125 comprises that portion of imaging system 117 configured to facilitate input of media 22. In the particular embodiment illustrated, media input 125 is configured to facilitate input of a stack of sheets of media 22. In one embodiment, media input 125 may include a tray aligning the sheets of media 22. In other embodiments, media input 125 may comprise other structures.

Media output 127 comprises that portion of imaging system 117 at which sheets of media 22 are discharged. In one embodiment, media output 127 may comprise an opening in housing 123 through which sheets are discharged. In another embodiment, media output 127 may comprise a storage bin or other structure configured to store sheets of media 22 upon which images have been formed and/or have been perforated by perforator system 120.

Imaging component 129 comprises a component configured to form an image upon media 22. In one embodiment, imaging component 129 comprises a fluid dispensing device configured to dispense imaging fluid such as fixing agents and inks upon media 22. In one exemplar embodiment, imaging component 129 comprises an inkjet print head. In another embodiment, imaging component 129 comprises a device configured to deposit toner upon media 22. For example, in one embodiment, imaging component 129 might comprise photo sensitive surface configured to be electrostaticly charged so as to form an electrostatic image and to electrostaticly transfer toner to media 22. In still other embodiments, imaging component 129 may comprise other devices configured to interact with media 22 so as to form an image upon media 22.

In operation, controller 142 generates control signals which are transmitted to torque source 136 which drives media feed 130 to pick a sheet of media 22 and to transfer the sheet of media 22 to a position relative to imaging component 129. Controller 142 generates additional control signals directing imaging component 129 to form an image upon media 22 based upon input image data. Thereafter, controller 142 generates control signals directing torque source 136 to drive media feed 130 to move media 22 relative to perforator components 32 and 34. Controller 142 also generates control signals directing torque source 136 to drive perforator components 32 and 34 via transmission 68 to selectively form perforations 76 and 80 (shown in FIGS. 2 and 3) at appropriate spacings to facilitate the desired tear pattern such as those shown in FIG. 4 or other tear patterns.

As shown in phantom in FIG. 5, in other embodiments, perforator system 120 may additionally include perforator components 132 and 134 configured to be selectively driven by torque source 136 via transmission 168. Perforator components 132 and 134 are similar to perforator components 32 and 34, respectively in that perforator components 132 and 134 are located on opposite sides of media path 144 and are configured to selectively form perforations 76 and 80 or to allow media 22 to move between and relative to components 132 and 134. Perforator components 132 and 134 may enhance the versatility of perforator system 120 by enabling perforator system 120 to form a greater number of different combinations of consecutive perforations in media 22. For example, perforator components 32, 34, 132 and 134 may be selectively driven to form greater than two consecutive perforations 76 (shown in FIG. 2) or greater than two consecutive perforations 80 (shown in FIG. 3) in media 22. Although perforator components 132 and 134 illustrated as being substantially identical to perforator components 32 and 34, respectively, perforator components 132 and 134 may alternatively have different configurations. In particular embodiments, each of perforator components 32, 34, 132 and 134 may have other configurations including other arrangements of blades and anvils.

Figure 6:
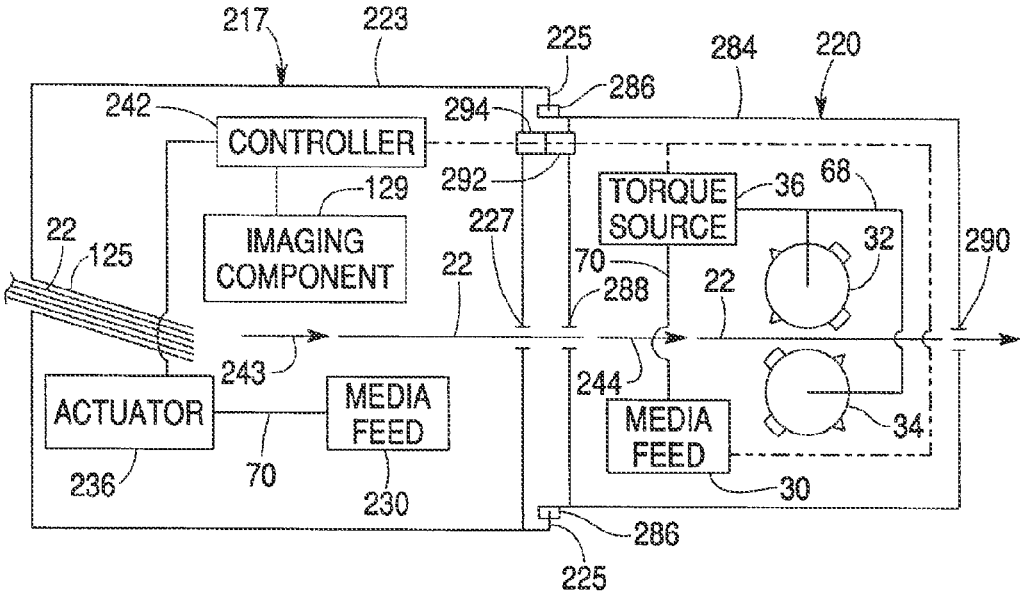
FIG. 6 schematically illustrates another embodiment of the perforator system of FIG. 1 incorporated into an add-on module for use with an imaging system according to one exemplary embodiment.

FIG. 6 schematically illustrates perforator system 220, another embodiment of perforator system 120, configured as an add-on module for use with imaging system 217. Perforator system 220 is similar to perforator system 20 except that perforator system 220 additionally includes housing 284, connectors 286, input opening 288, output opening 290 and communications interface 292. The remaining components of perforator system 220 which correspond to similar components of perforator system 20 are numbered similarly. Housing 284 comprises a structure configured to enclose, support and substantially surround components of perforator system 220. Connectors 286 comprise structures coupled to housing 284 and configured to releasably secure or attach housing 284 and perforator system 220 to imaging system 217. In one embodiment, connectors 286 may comprise resiliently flexible hooks configured to snap into corresponding detents of imaging system 217. In other embodiments, this relationship may be reversed or connector 286 may comprise other mechanisms for releasably fastening housing 284 and perforator system 220 to imaging system 217.

Input opening 288 comprises an opening within housing 284 configured to receive media 22 from imaging system 217. Output opening 290 comprises an opening in housing 284 configured to permit removal or discharge of perforated or unperforated media 22 from perforator system 220. In one embodiment, output opening 290 may comprise an opening configured to receive a tray or storage bin. In other embodiments, output opening 290 may comprise an opening through which media 22 is discharged by media feed 30.

Communications interface 292 comprises a port within housing 284 configured to facilitate communication with controller 242 of imaging system 217. In one embodiment, interface 292 may comprise a connector for connecting an optical or electrical communication cable or wire to perforator system 220. In another embodiment, interface 292 may comprise a plug configured to releasably mate with a corresponding plug associated with imaging system 217. In other embodiments in which communication is performed wirelessly, communications interface 292 may comprise a transceiver configured to receive such signals from imaging system 217.

Imaging system 217 is similar to imaging system 117 except that imaging system 217 omits those components of perforator system 120. Imaging 217 includes housing 223, connectors 225, media input 125, media output 227, imaging component 129, media feed 230, actuator 236 and controller 242. Housing 223 comprises one or more structures configured to enclose and support those components of imaging system 217. Connectors 225 comprise structures coupled to housing 223 configured to cooperate with connectors 286 of perforator system 220 releasably mount or attach perforator system 220 to housing 223 and imaging system 217. In one embodiment in which connectors 286 of perforator system 220 comprise openings or detents, connectors 225 may comprise resilient hooks or prongs configured to be received within such openings of connectors 286. In other embodiments, connector 225 may comprise other mechanisms configured to releasably connect imaging system 217 and perforator system 220.

Media input 125 is described above with respect to imaging system 117 and generally comprises a structure configured to input media 22 to imaging system 217. Media output 227 comprises an opening within housing 223 configured to facilitate passage of media 22 from imaging system 217 to perforator system 220. Although media output 227 is illustrated as an opening in housing 223, output 227 alternatively may comprise an opening formed by removing or moving a door, panel or other structure of housing 223.

Imaging component 129 is described above with respect to imaging system 117 and is configured to form an image upon media 22. Media feed 230 is similar to media feed 130 except that media feed 230 is configured to move and transport media 22 from media input 125, relative to imaging component 129 and to media output 227. Media feed 230 is further configured to move media 22 through media input 288 of perforator system 220 until the media is engaged by media feed 30 of perforator system 220. Media feed 230 may comprise a drum, a series of rollers, a series of belts, a shuttle tray and combinations thereof.

Actuator 236 comprises a source of power for media feed 230. In one embodiment, actuator 236 may comprise a torque source for providing torque to media feed 230. In another embodiment, actuator 236 may comprise a source of linear motion such as cylinder-piston assembly, solenoid and the like configured to drive media feed 230. As shown by FIG. 6, actuator 236 is operably coupled to media feed 230 by transmission 70 which may comprise one or more gears, belt and pulley arrangements, chain and sprocket arrangements, toothed belt and pinion arrangements and the like.

Controller 242 comprises a processing unit configured to generate control signals directing the operation of actuator 236 of imaging system 217. Controller 242 is further configured to generate control signals directing the operation of torque source 36 of perforator system 220. Control signals generated by controller 242 are communicated to torque source 36 of perforator system 220 by communications interface 294.

Communications interface 294 comprises a device configured to facilitate transfer of control signals from controller 242 of imaging system 217 to perforator system 220. In one embodiment, communication interface 294 may comprise a connector configured to be connected to an optical or electrical wire or cable which is itself connected to perforator system 220. In another embodiment, interface 294 may comprise a plug configured to mate with interface 292 of perforator system 220 for the transmission of control signals. In still another embodiment, interface 294 may comprise a transceiver for communicating and/or receiving wireless signals between imagining system 217 and perforator system 220.

In operation, controller 242 generates control signals based upon received or input image data. Such control signals are transmitted to actuator 236 and imaging component 129 to form an image upon media 22. Once an image has been formed upon the media, controller 242 generates additional control signals directing actuator 236 to drive media feed 230 to move the image containing sheet of media 22 along media path 243 and out media output 227 and into engagement with media feed 30 of perforator system 220. Based upon perforate data designating a pattern of perforations to be formed by perforator system 220, controller 242 communicates control signals to torque source 36 via communication interfaces 294 and 292. Such control signals from controller 242 direct torque source 36 to appropriately position perforator components 32 and 34 with respect to media 22 in either the open state (shown in FIG. 1) or the two perforating states (shown in FIGS. 2 and 3) for forming perforations 76 or perforations 80. Once each of the desired perforations have been formed in media 22, controller 242 generates control signals directing torque source 36 to drive media feed 30 so as to move the perforated media 22 through output opening 290 along media path 244.

FIG. 7 schematically illustrates perforator system 320, another embodiment of perforator system 20, configured as an add-on module for use with imaging system 317. Perforator system 320 is similar to perforator system 20 except that perforator system 320 specifically includes media feed 330 in lieu of media feed 30, and additionally includes housing 384, media input 388, media output 390, sensor 391, communications interface 392 and torque interface 393. Those remaining components of perforator system 320 which correspond to components of perforator system 20 are numbered similarly.

Media feed 330 is configured to transport or move media 22 along media feed path 344 from media input 388 to media output 390. In particular, media feed 330 is configured to move media 22 relative to perforator components 32 and 34 while perforator components 32 and 34 are substantially stationary. In the particular example illustrated, media feed 30 is configured to move media 22 in a generally linear plane between perforator components 32 and 34 substantially perpendicular to the axes about which perforator components 32 and 34 rotate. In other embodiments, media feed 330 may be configured to move media 22 between perforator components 32 and 34 in other fashions. In the particular example illustrated, media feed 330 comprises an upstream pair of rollers 400, 402 and a downstream pair of rollers 404, 406. In other embodiments, media feed 330 may comprise other structures to engage and move media along media path 344.

Housing 384 comprises one or more structures configured to enclose and support media feed 330, perforator components 32, 34, torque source 36, communications interface 392 and torque interface 393. In one embodiment, housing 384 is configured to be releasably attached to imaging system 317. The exact configuration of housing 384 may vary depending upon the configuration of the components it houses as well as its mounting relationship to imaging system 317.

Media input 388 comprises an opening in housing 384 configured to be aligned with an output opening on imaging system 317 such that media 22 may be moved into media path 344 within housing 384 and into engagement with media feed 330. Media output 390 comprises an opening in housing 384 configured for the discharge of perforated media 22. In the particular example shown, media output 390 additionally includes a tray in which discharge media may be stored.

Sensor 391 comprises a sensing device configured to sense positioning of media along media path 344. In one embodiment, sensor 391 may be configured to sense a leading or a trailing edge of media. In another embodiment, sensor 391 may be configured to sense other portions of media. Controller 242 drives torque source 36 based upon signals received from sensor 391. Although sensor 391 is depicted as being located between perforator component 32 and roller 400, sensor 391 may alternatively be located at other positions. For example, sensor 391 may alternatively be located between perforator component 32 and roller 404, between roller 400 and perforator component 34, between perforator component 34 and roller 406 or at other locations.

Communications interface 392 is similar to communications interface 292 of perforator system 220 (shown in FIG. 6). Communications interface 392 is configured to facilitate communication between controller 242 of imaging system 317 and torque source 36 of perforator system 320. In one embodiment, interface 392 may comprise a connector for connecting an optical or electrical communication cable or wire to perforator system 320. In another embodiment, interface 392 may comprise a plug configured to releasably mate with a corresponding plug associated with imaging system 317. In other embodiments in which communication is performed wirelessly, communications interface 392 may comprise a receiver configured to receive such signals from imaging system 317.

Torque interface 393 comprises a mechanism configured to facilitate the transfer of power or torque from imaging system 317 to media feed 330 when perforator system 320 is mounted or otherwise connected to imaging system 317. In the particular embodiment illustrated, torque interface 393 facilitates the transfer of torque to each of rollers 400, 404 which are rotatably driven opposite to idler rollers 402 and 406, respectively. In one embodiment, torque interface 393 may comprise a gear configured to mesh with an opposite corresponding gear of imaging system 317. In other embodiments, other means for transmitting torque from imaging system 317 to perforator system 320 may be utilized.

Imaging system 317 comprises a system configured to form an image upon media 22. Imaging system 317 is further configured to be removably attached or mounted to perforator system 320, to move media into perforator system 320, to supply torque to media feed 330 and to control operation of torque source 36 of perforator system 320 to selectively perforate media. Imaging system 317 is similar to imaging system 217 (shown and described with respect to FIG. 6) except that imaging system 317 additionally includes torque interface 395. The remaining components of imaging system 317 which correspond to imaging system 217 are numbered similarly. Torque interface 395 comprises a mechanism configured to interact with torque interface 393 of perforator system 320 so as to transfer torque from actuator 236 to rollers 400 and 404 of media feed 330. In one particular embodiment, torque interface 395 comprises a gear configured to mesh with a gear of torque interface 393 when perforator system 320 is releasably mounted to housing 223 of imaging system 317. In other embodiments other means for transferring torque or other force from actuator 236 to media feed 330 may be utilized.

In operation, controller 242 generates control signals directing actuator 236 to drive media feed 230 so as to pick a sheet of media 22 and to transfer the sheet of media 22 along media path 243 relative to imaging component 129. Controller 242 further generates control signals based upon image data directing imaging component 129 to form an image upon the picked sheet of media 22. Thereafter, controller 242 generates control signals directing actuator 236 to drive media feed 230 to further move the sheet of media 22 along media feed path 243 out media output 227 and into media input 388 of perforator system 320 until the sheet of media 22 is engaged by rollers 400 and 402 of media feed 330. Controller 242 generates control signals directing actuator 236 to supply torque to rollers 400 and 404 via a transmission 370, torque interface 395, torque interface 393 and transmission 397. Controller 242 generates control signals which are transmitted to torque source 36 of perforator system 320 via communication interfaces 292 and 392 directing torque source 36 to selectively rotate perforator components 32 and 34 to appropriately position perforator components 32 and 34 in either the open state (shown) or either of the two perforating states (shown in FIGS. 2 and 3) to perforate the sheet of media 22. Once all of the desired perforations have been formed in the sheet of media 22, controller 242 generates control signals directing actuator 236 to further supply torque to media feed 330 so as to discharge sheet of media 22 to media output 390.

FIGS. 8-12 illustrate perforator system 420, a specific embodiment of perforator system 320 shown and described with respect to FIG. 7. Perforator system 420 generally includes housing 484, media guides 486 (shown in FIGS. 11 and 12) media input 488, media output 490, communications interface 492, torque interface 493, transmission 497, media feed 530, perforator components 532, 534, torque source 536 and sensors 591 and 595. Housing 484 comprises one or more structures configured to enclose and support the remaining components of perforator system 420. In the particular embodiment illustrated, housing 484 is configured to be releasably mounted to an underlying printer such as imaging system 317 shown and described with respect to FIG. 7. In other embodiments, housing 484 may have other configurations and may be mounted to a printer in other fashions.

Media guides 486 (shown in FIGS. 11 and 12) comprise structures supported by housing 484 and configured to guide media from an underlying printer to media feed 530.

Media input 488 (shown in FIG. 11) comprises an opening or gap along the interior of housing 484 through which media from the underlying printer is supplied between the media guides 486. Media output 490 comprises a discharge area for media perforated by perforator system 420. As shown in FIG. 8, media output 490 may comprise an elongate tray upon which perforated media may be stored. In other embodiments, media output may have other configurations or may alternatively comprise an opening in housing 484.

Communication interface 492 (schematically shown in FIG. 9) is similar to communication interface 292 shown and described with respect to FIG. 7. Communication interface 492 is configured to facilitate communication between a controller, such as controller 242 (shown in FIG. 7), of a printer and sensors 591 and 595. Interface 492 further facilitates communication between the controller of the printer and torque source 536. In other embodiments, interface 492 may be omitted where perforator system 420 includes its own controller (such as controller 42 shown and described with respect to FIG. 1) and a user input configured to enable a person to select a desired perforating pattern.

Torque interface 493 comprises a structure configured to transmit or facilitate the transfer of torque from a printer, such as imaging system 317 shown and described with respect to FIG. 7, to media feed 530. In the particular embodiment illustrated, torque interface 493 comprises a gear configured to mesh with an adjacent gear (not shown) of a printer. In other embodiments, torque interface 493 may comprise other mechanisms configured to transfer torque to perforator system 420 from an associated printer or imaging system. In still other embodiments, torque interface 493 may be omitted where perforator system 420 includes a torque source for driving media feed 530.

Transmission 497 comprises a mechanism configured to transmit torque received via torque interface 493 to media feed 530. In the particular embodiment illustrated, transmission 497 includes pulleys 538, 539, 541, 543, 545 and belts or o-rings 547, 549, 551 and 553. Pulley 538 is operably coupled to torque interface 493, is operably coupled to an input portion of media feed 530, and is operably connected to pulley 539 by o-ring 547. Pulley 539 is rotatably supported by structure 487 and is operably coupled to pulley 541 by o-ring 549. Pulley 541 is rotatably supported by structure 487 and is operably coupled to pulley 543 by o-ring 551. Pulley 543 is rotatably supported by structure 487 and is operably coupled to pulley 545 by o-ring 553. Pulley 545 is connected to an output portion of media feed 530. Torque received via torque interface 493 rotatably drives the input portion of media feed 530. At the same time, torque is transmitted over perforator components 532 and 534 to rotatably drive an output portion of media feed 530. Although transmission 497 is illustrated as extending over perforator components 532 and 534 for space savings, transmission 497 may alternatively extend beneath or along an axial end of perforator components 532, 534. Although transmission 497 is illustrated as including pulleys and o-rings, transmission 497 may alternatively include a series of gears, one or more chain and sprocket arrangements, one or more toothed pinion and toothed belt arrangements and the like.

Figure 9:
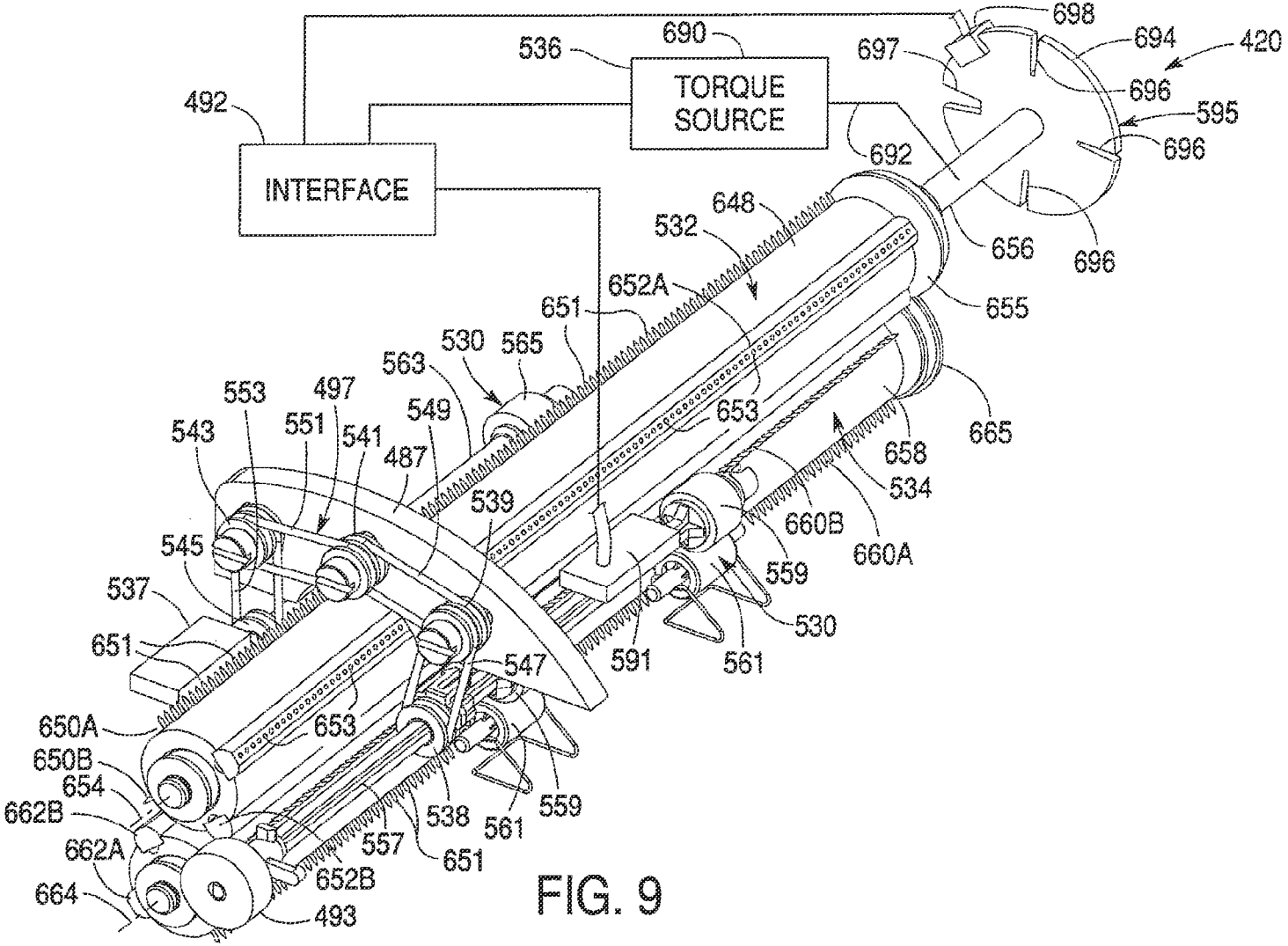
FIG. 9 is a front perspective view of the perforator system of FIG. 8 with portions removed for purposes of illustration according to one exemplary embodiment.
Figure 10:
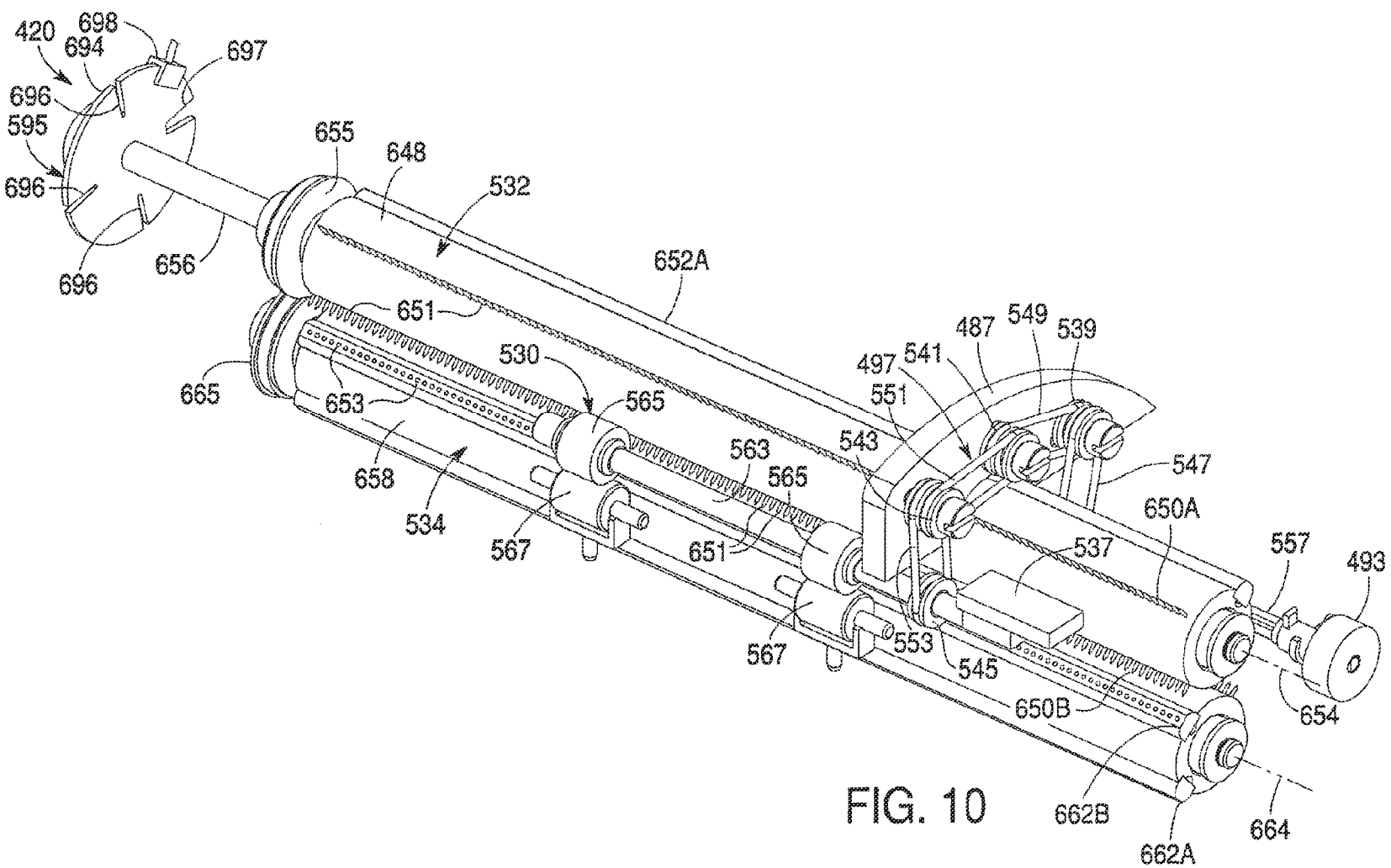
FIG. 10 is a rear perspective view of the perforator system of FIG. 8 with portions removed for purposes of illustration according to one exemplary embodiment.

Media feed 530 comprises a mechanism configured to move media, such as sheets of media, between perforator components 532 and 534 while perforator components 532 and 534 remain substantially stationary and in an open state as shown in FIGS. 9 and 10. Media feed 530 generally includes an input portion including shaft 557, nip rollers 559, idler rollers 561 (shown in FIG. 9), shaft 563, nip rollers 565 (shown in FIG. 10) and idler rollers 567. Shaft 557 is rotatably supported by media guide 486 and is coupled to torque interface 493 so as to be rotatably driven in response to rotation of torque interface 493. Shaft 557 is coupled to pulley 538 such that pulley 538 is rotated upon rotation of shaft 557 to transmit torque to shaft 563 of the output portion of media feed 530. Shaft 557 supports nip rollers 559.

Nip rollers 559 are configured to be rotatably driven with the rotation of shaft 557. Nip rollers 559 oppose idler rollers 561. Nip rollers 559 and idler rollers 561 cooperate to engage opposite sides of a media on an input side of perforator components 532 and 534 to drive media with respect to perforator components 532, 534.

Shaft 563 is a shaft rotatably supported by a bearing block 537 associated with media guide 486. Shaft 563 is coupled to pulley 545. Shaft 563 extends along an output side of perforator components 532 and 534 and is coupled to pulley 545 so as to rotate with rotation of pulley 545. Shaft 563 is further coupled to nip rollers 565 such that nip rollers 565 rotate upon the rotation of shaft 563. Nip rollers 565 comprise cylindrical members opposing idler rollers 567. Nip rollers 565 and idler rollers 567 cooperate to engage opposite sides of a media to move media with respect to perforator components 532 and 534.

Perforator components 532 and 534 are similar to perforator components 32 and 34 (described with respect to FIG. 1). Perforator component 532 includes rotatable member 648, blades 650A, 650B (collectively referred to as blades 650), anvils 652A, 652B (collectively referred to as anvils 652), drive gear 655 and drive shaft 656. Perforator component 534 includes rotatable member 658, blades 660A, 660B (collectively referred to as blades 660), anvils 662A, 662B (collectively referred to as anvils 662) and drive gear 665. Rotatable members 648 and 658 are substantially similar to one another. Each of rotatable member 648 and 658 comprises an elongate cylindrical structure coupled to their respective blades and anvils. In particular, rotatable member 648 supports blades 650 and anvils 652 for rotation about axis 654. Rotatable member 658 supports blades 660 and anvils 662 for rotation about axis 664.

The blades 650 include discrete knives 651, which may also be referred to as blades or pins. The discrete knives 651 are arranged in substantially linear fashion along a longitudinal direction of the surface of the rotatable member 648. The anvils 652 include apertures 653 that are also arranged such that the knives 651 may at least partially enter the apertures 653 as the knives 651 and apertures 653 move into opposing positions to pierce media.

Figure 11:
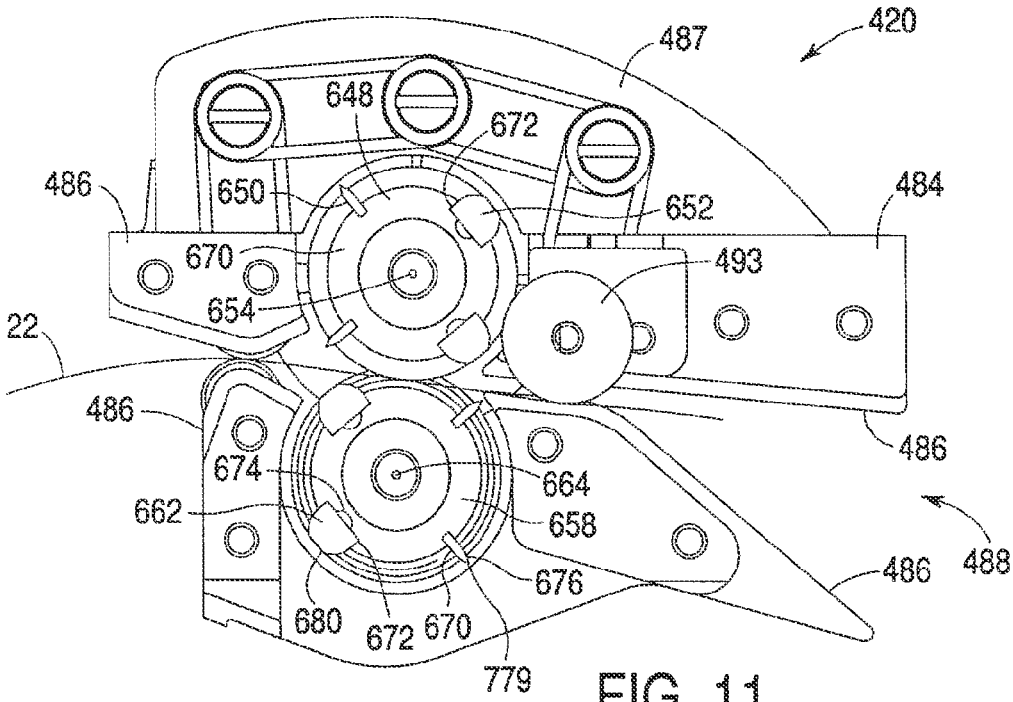
FIG. 11 is a side elevational view of the perforator system of FIG. 8 in open state with portions removed for purposes of illustration according to one exemplary embodiment.
Figures 12A, 13:
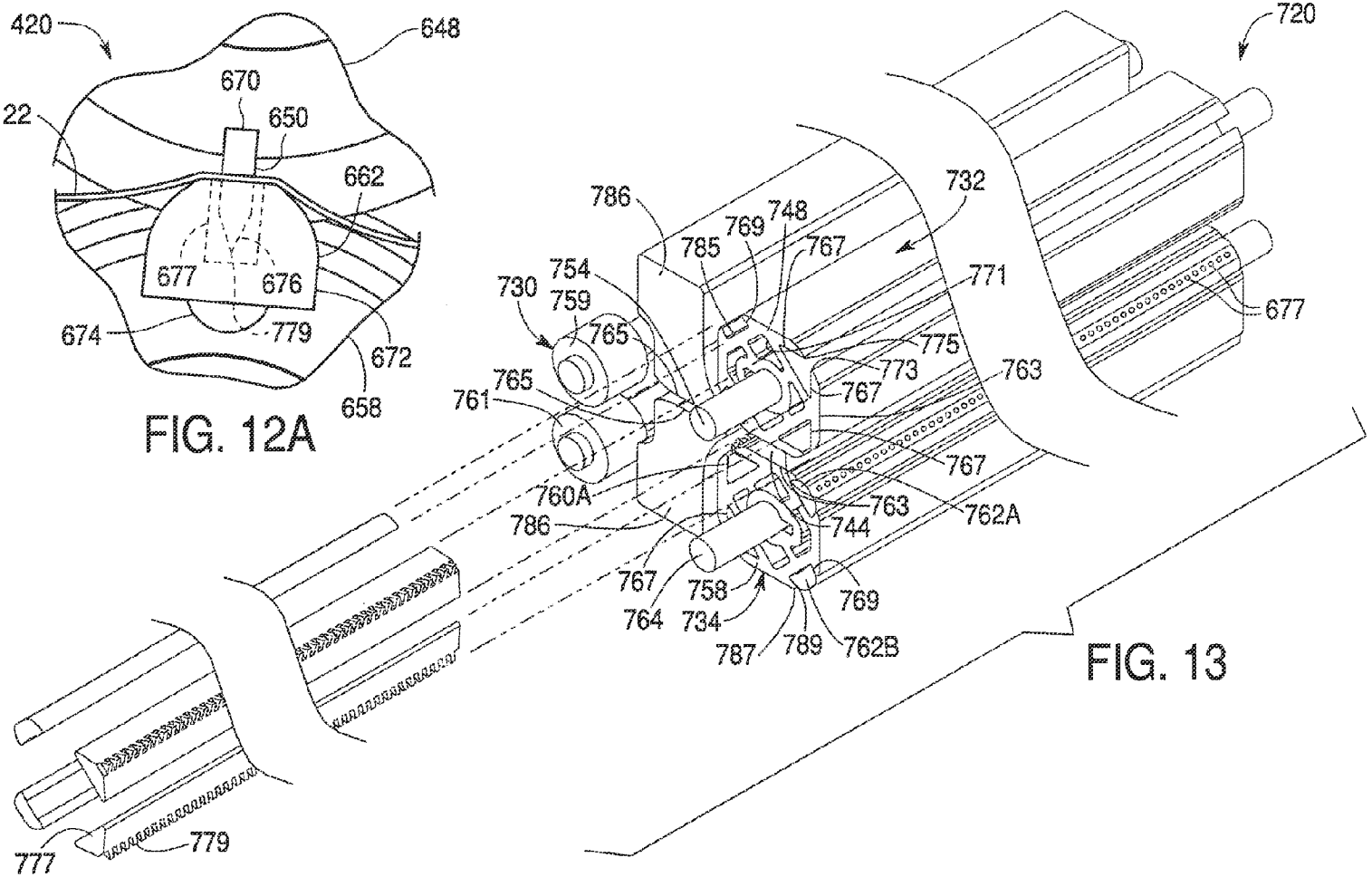
FIG. 12A is a greatly enlarged view of the perforator system of FIG. 12 taken along line 12A-12A according to one exemplary embodiment.
FIG. 13 is a partially exploded perspective view of another embodiment of the perforator system of FIG. 1 according to one exemplary embodiment.

As shown by FIG. 11, rotatable members 648 and 658 each include elongate slots or grooves 670 in which blades 650 and blades 660 are received and secured. Rotatable members 648 and 658 additionally include channels 672 in which anvils 652 and 662 are received and secured. Channels 672 each include an elongate groove or cavity 674. As shown by FIG. 12A, anvil 662 includes holes 677 configured to receive at least a portion of the blade 650 when the blade 650 is piercing or deforming the media 22.

As further shown by FIG. 11, each of blades 650, 660 has elongate tapering sides 676 terminating at a point 779. Each of anvils 652, 662 includes an elastomeric blade-engaging portion. This portion may comprise a series of apertures, a longitudinally-elongated groove or notch (not shown).

According to one exemplary embodiment, blades 650, 660 are formed from a relatively rigid material such as steel. Anvils 652, 662 are formed from a resiliently compressible material having a shore A durometer of between about 40 and 60. In one embodiment, anvils 652, 662 include blade engaging portions formed from a material such as polyurethane. In other embodiments. Anvils 652, 662 may be formed from other materials such as neoprene or Buna-N rubber. Although the entirety of each of anvils 652, 662 is illustrated as being formed from a single material or a blend of materials, in other embodiments, anvil 652, 662 may be formed from multiple portions of materials co-molded or otherwise secured to one another.

In the particular embodiment illustrated in FIGS. 8-12, blades 650, 660 and anvils 652, 662 are generally arranged similar to blades 50, 60 and anvils 52, 62 of perforator system 20 (shown and described with respect to FIGS. 1-3). As a result, perforator components 632, 634 are configured to form each of the perforating patterns for the associated tear patterns illustrated in FIG. 4. In other embodiments, perforator components 632 and 634 may have a greater or smaller number of such anvils and blades in alternative arrangements about rotatable member 648 and 658.

In the particular embodiment illustrated, axes 654 and 664 about which rotatable members 648 and 658 rotate are spaced from one another by about 25.4 millimeters (one inch). The outer surface of rotatable members 648 and 658 are spaced from one another by at least about 3.4 millimeters. As a result, when in an open position, perforator components 632 and 634 may accommodate movement of media between components 632 and 634 by media feed 530 of up to a thickness of about 3.4 millimeters while components 632 and 634 are stationary (not rotating). In other embodiments, components 632 and 634 may be spaced from one another by other distances.

Drive gears 655 and 665 are coupled to rotatable members 648 and 658, respectively. Drive gears 655 and 665 mesh with one another so as to synchronize rotation of components 532 and 534. In other embodiments, rotation of components 532 and 534 may be synchronized by other mechanisms such as chain and sprocket arrangements, belt and pulley arrangements or other similar mechanical arrangements. In other embodiments, components 532 and 534 may be rotatably driven by separate torque sources at the same speed.

Drive shaft 656 is coupled to rotatable member 648 and is in operable engagement with torque source 536. Torque source 536 comprises a mechanism to supply torque to perforator component 532 which results in perforator component 534 also being rotated. In the particular embodiment illustrated, torque source 536 comprises a motor operably coupled to drive shaft 656, which comprises a follower gear, by worm gear 692 connected to an output shaft of motor 690. In one particular embodiment, torque source 536 comprises a stepper motor configured to selectively drive perforator components 532 and 534 in either of opposite directions. In other embodiments, drive shaft 656 may have other configurations and torque source 536 may be operably coupled to shaft 656 by other mechanisms such as a belt and pulley arrangement, a chain and sprocket arrangement, a series of gears, or the like.

Sensor 591 comprises a sensing device configured to detect the presence of media. In the particular embodiment illustrated, sensor 591 comprises a reflective sensor supported by media guide 486 (shown in FIGS. 11 and 12). In other embodiments, sensor 591 may comprise other sensing devices. In the particular example shown, sensor 591 is supported on an input side of perforator components 532, 534. In another embodiment, sensor 591 may be located and supported on an output side of perforator components 532, 534. Sensor 591 detects a leading edge of media being fed by media feed 530 to perforator components 532, 534. Sensor 591 generates signals based upon detection of media and transmits such signals to the controller of the associated printer via interface 492.

Sensor 595 comprises a sensing device configured to sense position of perforator component 532 from which may be determined the positioning of perforator component 534. In embodiments where perforator components 532 and 534 are not synchronized with one another, system 420 may include an additional sensor for detecting the position of perforator component 534. In the particular example shown, sensor 595 comprises an interference sensor comprising an encoder wheel 694 having slots 696 and homing slot 697, and optical sensor 698. Slots 696 permit light from a transmitter portion of sensor 698 to be received by a light sensitive portion of sensor 698 as perforator component 532 is rotatably driven by torque source 536. Homing slot 697 facilitates counting of the number of rotations of wheel 694 by optical sensor 698. In response to rotation of wheel 694, optical sensor 698 generates and transmits signals to the controller of the associated printer (not shown) via interface 492. In other embodiments, sensor 595 may comprise other sensing devices.

Figure 12:
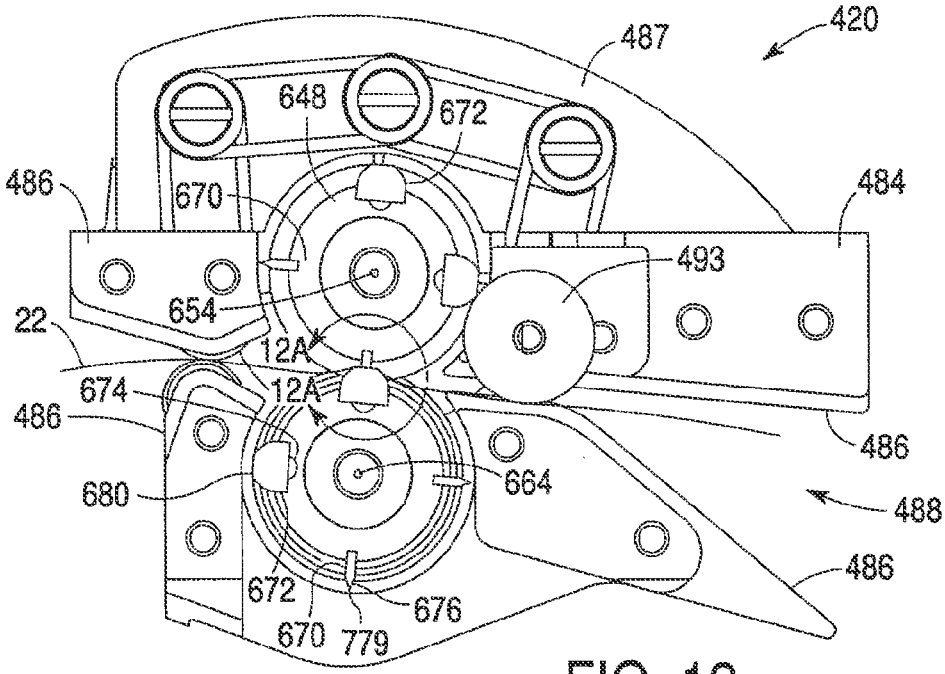
FIG. 12 is a side elevational view of the perforator system of FIG. 8 in a perforating state with portions removed for purposes of illustration according to one exemplary embodiment.

In operation, a controller of an associated printer, such as controller 242 of imaging system 317 (shown and described with respect to FIG. 7) generates control signals causing an actuator or torque source associated with the printer to transmit torque to media feed 530 via torque interface 493. The torque transmitted by torque interface 493 results in nip rollers 559 being rotatably driven. The torque is further transmitted by transmission 497 to rotatably drive nip rollers 565. As a result, a sheet of media from the associated printer is fed to a position between perforator components 532 and 534. Based upon signals received from sensor 591 as well as the last known positioning of perforator components 532 and 534 as indicated by signals from sensor 595 and/or an encoder associated with torque source 536, the controller of the associated printer generates control signals which are transmitted to motor 690 via interface 492. In response to such signals, torque source 536 rotatably drives perforator components 532 and 534 to either an open position shown in FIG. 11, allowing media feed 530 to selectively move a sheet of media relative to perforator components 532, 534 or a perforating state such as shown in FIG. 12. Once each of the desired perforations have been formed in the media 22 at the desired spacings, the controller of the associated printer generates control signals causing torque to be supplied to media feed 530 to further move the perforated sheet of media 22 to output 490 (shown in FIG. 8).

Figure 14:
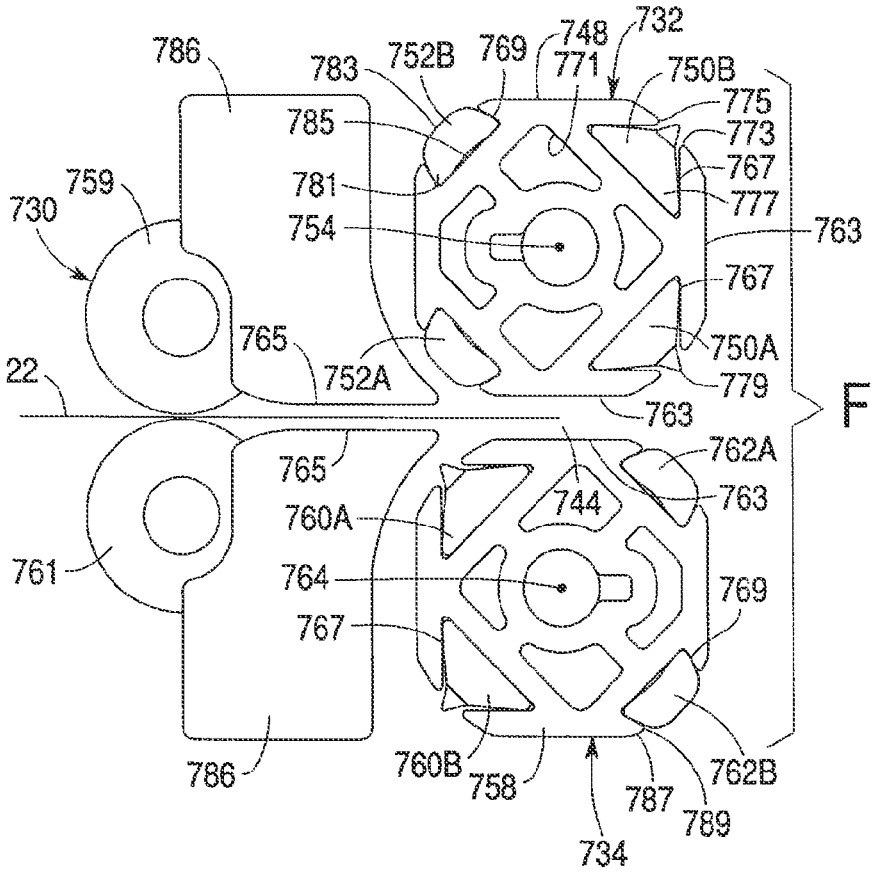
FIG. 14 is a side elevational view of the perforator system of FIG. 13 in an open state according to one exemplary embodiment.
Figure 15:
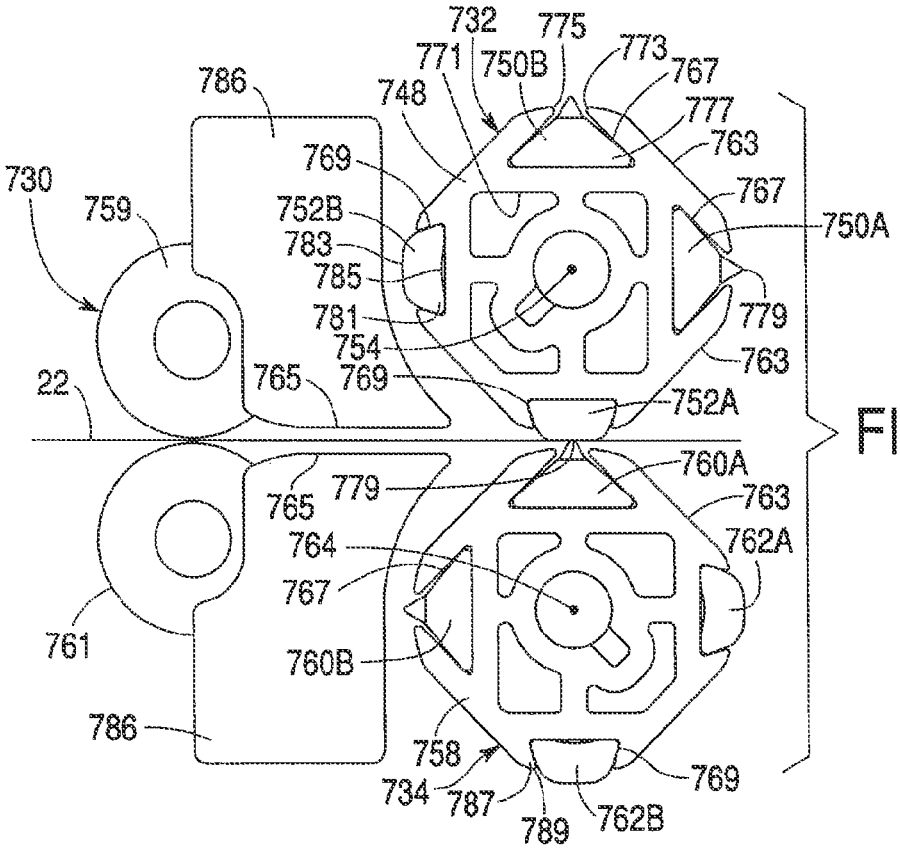
FIG. 15 is a side elevational view of the perforator system of FIG. 13 in a perforating state according to one exemplary embodiment.

FIGS. 13-15 illustrate perforator system 720, another embodiment of perforator system 20 shown in FIG. 1. Perforator system 720 is similar to perforator system 20 except that perforator system 720 includes perforator components 732, 734 in lieu of perforator components 32 and 34. Perforator component 732 includes rotatable member 748, blades 750A, 750B (collectively referred to as blades 750) and anvils 752A, 752B (collectively referred to as anvils 752). Perforator component 734 includes rotatable member 758, blades 760A, 760B (collectively referred to as blades 760) and anvils 762A, 762B (collectively referred to as anvils 762). Rotatable members 748 and 758 comprise elongate members configured to be rotatably driven about axes 754 and 764, respectively. Rotatable members 748 and 758 are substantially identical to one another. Each of rotatable member 748 and 758 comprises an elongate polygonal structure configured to support blades 750, 760 and anvils 752, 762. In the particular example shown, each of rotatable members 748 and 758 comprises an elongate structure having four substantially planar faces or sides 763.

As shown by FIG. 14, the substantially planar sides 763 cooperate to form a generally planar media path 744 between perforator components 732 and 734 which facilitates movement of media 22 between perforator components 732 and 734 while components 732 and 734 remain substantially stationary. In the particular embodiment shown in FIG. 14, when components 732 and 734 are in the open position shown, opposing sides 763 of rotatable members 748 and 758 are substantially parallel to the opposing surfaces 765 of media guides 786 and the plane passing between rollers 759 and 761 of media feed 730. This configuration may facilitate smoother movement of media 22 between and relative to perforator components 732 and 734 when components 732 and 734 are in the open state shown.

Although rotatable members 748 and 758 are illustrated as having four sides, perforator components 732 and 734 may alternatively have a greater or fewer number of such sides. Although rotatable members 748 and 758 are illustrated as being substantially identical to one another, in other embodiments rotatable members 748 and 758 may have different configurations as compared to one another.

As further shown by FIG. 14, each of rotatable members 748 and 758 includes elongate channels 767 and 769. Channels 767 and 769 extend along axes 754 and 764 generally at an intersection of sides 763. Channels 767 are configured to slideably receive and radially contain blades 750 and blades 760. Likewise, channels 769 are configured to slideably receive and radially contain anvils 752 and anvils 762.

In the particular example shown, each of rotatable members 748 and 758 include elongate hollow interior portions 771 between axes 754, 764 and faces or sides 763. Hollow interior portions 771 may reduce the weight and power to rotatably drive perforator components 732 and 734 while reducing the material of rotatable members 748 and 758. In the particular example shown, rotatable members 748 and 758 have extruded cross sections, reducing manufacturing costs of rotatable members 748 and 758. In one embodiment, members 748 and 758 are extruded from lightweight metal such as aluminum. In other embodiments, rotatable member 748 and 758 may be formed from other materials and may have other configurations.

Blades 750 and blades 760 are substantially similar to one another. As shown by FIG. 13, blades 750 and blades 760 are configured to be slideably received and radially contained within channels 767. In the particular example shown, channels 767 have a triangular cross-sectional shape having an elongate neck portion 773 extending along an opening 775. Blades 750 and 760 have a generally triangular cross-sectional shape including a wide base portion 777 and an elongate tip 779. When blades 750, 760 are slid along axes 754 and 764 into channels 767, base 777 is captured while tip 779 projects through opening 775 beyond neck 773.

In one particular embodiment, blades 750, 760 are formed from a relatively rigid material such as steel. In other embodiments, blades 750, 760 may be formed from other materials. Although blades 750, 760 are illustrated as being formed as single unitary bodies, blades 750, 760 may alternatively include multiple components or multiple materials molded, fastened, adhered or otherwise secured to one another. For example, in another embodiment, base 777 may be formed from a first material while that portion of blades 750, 760 providing tip 779 may be formed from another material or be provided by another member secured to base 777. Although channels 767 and blades 750, 760 are illustrated as having generally triangular cross-sectional shapes, channels 767 and blades 750, 760 may have other configurations.

Anvils 752, 762 are substantially similar to one another. Each of anvils 752 and 762 is configured to be slideably received and radially contained within channel 769 of rotatable members 748 and 758, respectively. In the particular example illustrated, each of anvils 752, 762 includes an axially extending base portion 781, an elastomeric or resiliently compressible blade engaging portion 783 and an elongate cavity 785. Base portion 781 is configured to be slideably positioned within channel 769 while radially retained in its associated anvil 752, 762 within channel 769. In the particular example illustrated, channel 769 includes a narrowing neck portion 787 forming an opening 789. Base portion 781 is radially captured within channel 769 below neck 787 with blade engaging portion 783 projecting through opening 789 beyond neck portion 787. As shown by FIG. 13, anvils 752, 762 are axially slid into channel 769 along axes 754 and 764 to releasably couple anvil 752, 762 to rotatable members 748 and 758. As a result, anvils 752, 762 may be removed for repair or replacement with reduced effort and potentially without, or with minimal use of, tools.

Blade engaging portions 783 of anvils 752, 762 comprise relatively soft, compressible surfaces against which tip 779 of blades 750, 760 depress media 22 during perforating as shown in FIG. 15. In one particular embodiment, anvils 752, 762 are formed as a single unitary body from a resiliently compressible material having a hardness of between about 40 and 60 shore A. In one embodiment, anvils 752, 762 are formed from a material such as polyurethane. In other embodiments, anvils 752 and 762 may be formed from other materials such as neoprene or Buna-N rubber. Although anvils 752 and 762 are illustrated as being integrally formed as single unitary bodies, anvils 752 and 762 may alternatively be formed from distinct components or members or molded, fastened, adhered or otherwise secured to one another.

Cavity 785 axially extends along a bottom side of anvils 752, 762 generally opposite to blade engaging portion 783. In the particular example shown, cavity 785 comprise concave surfaces axially extending along anvils 752, 762. Cavity 785 facilitates resilient deformation of blade engaging portions 783 when being engaged by blades 750, 760. As shown by FIG. 15, tip 779 presses media 22 against portion 783 which results in anvil 752A and its cavity 785 flattening out within channel 769 such that blade engaging portion 783 curves or partially wraps about tip 779 to form a sharp perforate in media 22. In other embodiments, cavity 785 may be omitted and/or blade engaging portion 785 may include a notch for receiving tip 779.

Figure 16:
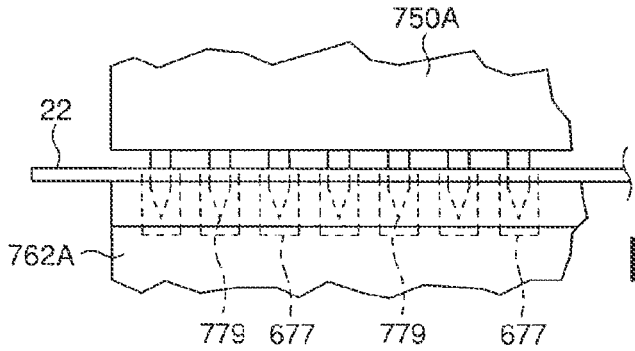
FIG. 16 is a side elevational view of the perforator system of FIG. 13 in a perforating state according to one exemplary embodiment.

FIG. 16 illustrates an example embodiment of a portion of the system 720 and shows discrete tips 779 of blade 750A within apertures 677 of anvil 762A. The media 22 is shown as pierced by the tips 779 with the tips 779 engaged with the apertures 677.

Figure 17:
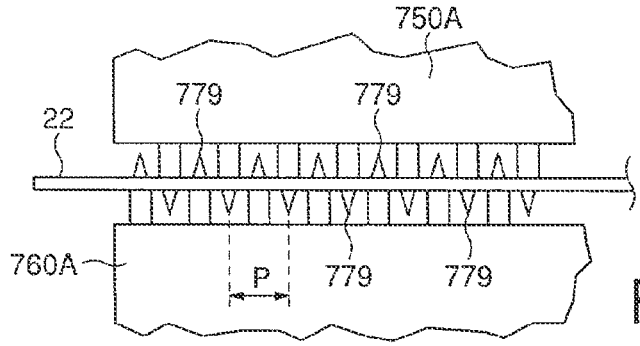
FIG. 17 is a side elevational view of the perforator system of FIG. 13 in a perforating state according to one exemplary embodiment.
Figure 18:
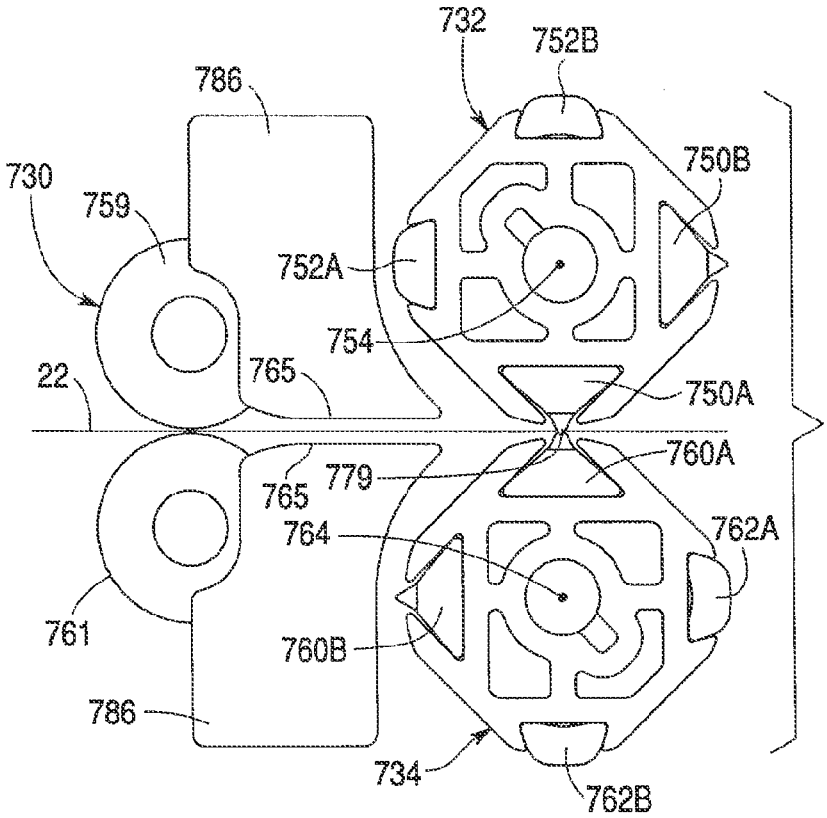
FIG. 18 is a side elevational view of the perforator system of FIG. 13 in a perforating state according to one exemplary embodiment.

FIGS. 17 and 18 illustrate another example embodiment of a portion of the system 720. In this embodiment, the blades 750A and 760A mesh with each other and pierce the media 22 during overlapping time frames. The blade 750A may pierce the media 22 at a time when the blade 760A is also piercing the media 22.

As an example configuration, the tips 779 of the blade 750A may be offset relative to the tips 779 of the blade 766A by about one-half of the pitch distance P between the tips of the blade 750A. Thus, in this embodiment, when the two rollers 732, 734 rotate, blades 750A and 760A mesh together to permit some of the perforations to come from the blade 750A and the other of the perforations to come from the blade 760A. In some embodiments, the blades 750A and 760A do not contact each other during perforating of the media 22.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. A method comprising:

moving a medium between and relative to both a first rotatable member, supporting a first structure, and a second rotatable member, supporting a first blade, to selectively position one of a continuum of portions of the medium relative to the first structure and the first blade, wherein the first rotatable member includes consecutive anvils, including a first anvil and a second anvil, without any blade between the first anvil and the second anvil along a perimeter of the first rotatable member, and consecutive blades, including a first blade and a second blade, without any anvil between the first blade and the second blade along the perimeter of the second rotatable member; and perforating the medium between the first structure and the first blade, wherein the second rotatable member is coupled to a second structure comprising the second blade, the method further comprising:

rotating the first rotatable member in a clockwise direction while concurrently rotating the second rotatable member in a counterclockwise direction to perforate the medium between the first structure and the first blade of the second rotatable member; and rotating the first rotatable member in the counterclockwise direction while concurrently rotating the second rotatable member in the clockwise direction to perforate the medium between the second structure and the second blade of the first rotatable member.

2. The method of claim 1, wherein the medium is moved between and relative to both the first rotatable member and the second rotatable member while the first rotatable member and the second rotatable member are stationary.

3. The method of claim 1, wherein the first rotatable member is polygonal and wherein the second rotatable members polygonal.

4. The method of claim 1 further comprising:

providing a media path extending between the first rotatable member and the second rotatable member;

rotating the first rotatable member to a first angular position in which the first structure projects from the first rotatable member towards the media path in a first direction oblique to a plane of the media path between the first rotatable member and the second rotatable member such that the first structure terminates prior to reaching the media path;

rotating the second rotatable member to a second angular position in which the first blade projects from the second rotatable member towards the media path in second directions oblique to the plane of the media path between the first rotatable member and the second rotatable member such that the first blade terminates prior to reaching the media path;

driving the medium between and relative to both the first rotatable member in the first angular position and the second rotatable member in the second angular position without any blade and any corresponding structure of either of the first rotatable member or the second rotatable member perforating media therebetween as the media is being driven relative to both the first rotatable member and the second rotatable member; and rotating the first rotatable member in a clockwise direction from the first angular position and the second rotatable member in a counterclockwise direction from the second angular position to bring the first structure and the first blade into engagement with the medium to perforate the medium at a selected one of a continuum of locations along the medium.

5. The method of claim 1 further comprising:

supporting the first rotatable member and the second rotatable member with a frame; and releasably and operably engaging a first transmission of a printer to a second transmission supported by the frame and operably coupled to the first rotatable member and the second rotatable member to transmit torque from the printer to the first rotatable member and the second rotatable member.

6. A method comprising:

moving a medium between and relative to both a first rotatable member, supporting a first anvil, and a second rotatable member, supporting a first blade, to selectively position one of a continuum of portions of the medium relative to the first anvil and the first blade;

perforating the medium between the first anvil and the first blade, wherein the first rotatable member is coupled to a second blade and wherein the second rotatable member is coupled to a second anvil, the method further comprising:

rotating the first rotatable member in a clockwise direction while concurrently rotating the second rotatable member in a counterclockwise direction; and rotating the first rotatable member in the counterclockwise direction while concurrently rotating the second rotatable member in the clockwise direction.

7. The method of claim 6 further comprising driving the medium between and relative to both the first rotatable member and the second rotatable member without any blade and any corresponding anvil of either of the first rotatable member or the second rotatable member perforating media therebetween as the media is being driven relative to both the first rotatable member and the second rotatable member such that the first blade may engage media against the first anvil at a continuum of locations along the medium.

8. The method of claim 6, wherein the medium is moved between and relative to both the first rotatable member and the second rotatable member while the first rotatable member and the second rotatable member are stationary.

9. The method of claim 6, wherein the first rotatable member is polygonal and wherein the second rotatable members polygonal.

10. The method of claim 6, wherein the first rotatable member includes consecutive anvils, including the first anvil and a third anvil, without any blade between the first anvil and the third anvil along a perimeter of the first rotatable member, and consecutive blades, including the second blade and a third blade, without any anvil between the second blade and the third blade along the perimeter of the first rotatable member.

11. The method of claim 6, wherein the first blade is spaced 90 degrees from the second anvil and wherein the second blade is spaced 90 degrees from the first anvil.

12. The method of claim 6, wherein the first anvil has an elastomeric blade-engaging portion having a blade contacting surface on a first side of the first anvil and wherein the first rotatable member includes a cavity opposite the blade-engaging portion on a second opposite side of the first anvil and wherein the method further comprises elastomerically deforming the first anvil into the cavity when in engagement with the first blade such that the first anvil elastomerically bends and deforms to converge about the blade.

13. The method of claim 6 further comprising rotating the first rotatable member about a first axis, the first rotatable member including three substantially planar faces extending along the first axis, wherein the three substantially planar faces of the first rotatable member are contiguous and face in a first radial direction away from the first axis and rotating the second rotatable member about a second axis, the second rotatable member including three substantially planar faces extending along the second axis, wherein the three substantially planar faces of the second rotatable member are contiguous and face in a second radial direction away from the second axis.

14. The method of claim 6 comprising:

rotating the first rotatable member about a first axis, the first rotatable member including a first channel extending along the first axis; and sliding the first anvil in the first channel along the first axis so as to radially contain the first anvil within the first channel.

15. The method of claim 14, wherein the first channel comprise a constricted opening through which the first anvil extends when being slid along the first axis.

16. The method of claim 6 further comprising:

supporting the first rotatable member and the second rotatable member with a frame; and releasably and operably engaging a first transmission of a printer to a second transmission supported by the frame and operably coupled to the first rotatable member and the second rotatable member to transmit torque from the printer to the first rotatable member and the second rotatable member.

17. A method comprising:

providing a media path extending between a first rotatable member supporting a first anvil and one of a second anvil and a first blade and a second rotatable member opposite the first rotatable member and supporting a second blade and the other of the second anvil and the first blade;

rotating the first rotatable member to a first angular position in which the first anvil and said one of the second anvil and the first blade project from the first rotatable member towards the media path in directions oblique to a plane of the media path between the first rotatable member and the second rotatable member such that the first anvil and said one of the second anvil and the first blade both terminate prior to reaching the media path;

rotating the second rotatable member to a second angular position in which the second blade and said other of the second anvil and the first blade project from the second rotatable member towards the media path in directions oblique to the plane of the media path between the first rotatable member and the second rotatable member such that the second blade and said other of the second anvil and the first blade both terminate prior to reaching the media path;

moving a medium between along the media path and relative to both the first rotatable member and the second rotatable member while the first rotatable member is in the first angular position and while the second rotatable member is in the second angular position to selectively position one of a continuum of portions of the medium between the first rotatable member and the second rotatable member such that a line intersecting rotational axes of the first rotatable member and the second rotatable member and extending perpendicular to the media path intersects said one of the continuum of portions of the medium; and rotating the first rotatable member in a clockwise direction from the first angular position and the second rotatable member in a counterclockwise direction from the second angular position to bring the first anvil and the second blade into engagement with one another to perforate said one of the continuum of portions of the medium.

18. The method of claim 17 further comprising:

rotating the first rotatable member to the first angular position in which the first anvil and said one of the second anvil and the first blade project from the first rotatable member towards the media path in directions oblique to the plane of the media path between the first rotatable member and the second rotatable member such that the first anvil and said one of the second anvil and the first blade both terminate prior to reaching the media path;

rotating the second rotatable member to the second angular position in which the second blade and said other of the second anvil and the first blade project from the second rotatable member towards the media path in directions oblique to the plane of the media path between the first rotatable member and the second rotatable member such that the second blade and said other of the second anvil and the first blade both terminate prior to reaching the media path;

moving a medium between and relative to both the first rotatable member and the second rotatable member along the media path while the first rotatable member is in the first angular position and while the second rotatable member is in the second angular position to selectively position a second of a continuum of portions of the medium between the first rotatable member and the second rotatable member such that the line intersecting rotational axes of the first rotatable member and the second rotatable member and extending perpendicular to the media path intersects said second of the continuum of portions of the medium; and rotating the first rotatable member in a counterclockwise direction from the first angular position and the second rotatable member in a clockwise direction from the second angular position to bring the second anvil and the first blade into engagement with one another to perforate said second of the continuum of portions of the medium.

19. The method of claim 17, wherein:

the rotating of the first rotatable member to the first angular position occurs about a first axis, the first rotatable member being polygonal and including three substantially planar faces extending along the first axis, wherein the three substantially planar faces of the first rotatable member are contiguous and face in a first radial direction away from the first axis, wherein the first anvil and said one of the second anvil and first blade extend from intersecting corners of the three substantially planar faces of the first rotatable member and wherein one of the three substantially planar faces of the first rotatable member extends parallel to and faces the media path when the first rotatable member is in the first angular position; and the rotating of the second rotatable member to the second angular position occurs about a second axis, the second rotatable member being polygonal and including three substantially planar faces extending along the second axis, wherein the three substantially planar faces of the second rotatable member are contiguous and face in a second radial direction away from the second axis, wherein the second blade and said one of the second anvil and first blade extend from intersecting corners of the three substantially planar faces of the second rotatable member and wherein one of the three substantially planar faces of the second rotatable member extends parallel to and faces the media path when the second rotatable member is in the second angular position.

20. The method of claim 17, wherein the medium is moved between and relative to both the first rotatable member and the second rotatable member along the media path while the first rotatable member is stationary in the first angular position and while the second rotatable member is stationary in the second angular position.

21. A method comprising:

moving a medium between and relative to both a first rotatable member, supporting a first structure, and a second rotatable member, supporting a first blade, to selectively position one of a continuum of portions of the medium relative to the first structure and the first blade, wherein the first rotatable member includes consecutive anvils, including a first anvil and a second anvil, without any blade between the first anvil and the second anvil along a perimeter of the first rotatable member, and consecutive blades, including a first blade and a second blade, without any anvil between the first blade and the second blade along the perimeter of the second rotatable member;

perforating the medium between the first structure and the first blade;

providing a media path extending between the first rotatable member and the second rotatable member;

rotating the first rotatable member to a first angular position in which the first structure projects from the first rotatable member towards the media path in a first direction oblique to a plane of the media path between the first rotatable member and the second rotatable member such that the first structure terminates prior to reaching the media path;

rotating the second rotatable member to a second angular position in which the first blade projects from the second rotatable member towards the media path in second directions oblique to the plane of the media path between the first rotatable member and the second rotatable member such that the first blade terminates prior to reaching the media path;

driving the medium between and relative to both the first rotatable member in the first angular position and the second rotatable member in the second angular position without any blade and any corresponding structure of either of the first rotatable member or the second rotatable member perforating media therebetween as the media is being driven relative to both the first rotatable member and the second rotatable member; and rotating the first rotatable member in a clockwise direction from the first angular position and the second rotatable member in a counterclockwise direction from the second angular position to bring the first structure and the first blade into engagement with the medium to perforate the medium at a selected one of a continuum of locations along the medium.

* * * * *

UNITED STATES PATENT AND TRADEMARK OFFICE

CERTIFICATE OF CORRECTION

PATENT NO. : 8,539,867 B2
APPLICATION NO. : 13/423238
DATED : September 24, 2013
INVENTOR(S) : Wade A. Powell et al.

It is certified that error appears in the above-identified patent and that said Letters Patent is hereby corrected as shown below:

In the Claims

In column 19, line 4, in Claim 3, delete “members” and insert -- member is --, therefor.

In column 19, line 19, in Claim 4, delete “directions” and insert -- direction --, therefor.

In column 20, line 12, in Claim 9, delete “members” and insert -- member is --, therefor.

In column 23, line 7, in Claim 21, delete “directions” and insert -- direction --, therefor.

Signed and Sealed this
Tenth Day of December, 2013

Margaret A. Focarino

Margaret A. Focarino
*Commissioner for Patents of the United States Patent and Trademark Office*